US008435400B2

(12) United States Patent
Kou et al.

(10) Patent No.: US 8,435,400 B2
(45) **Date of Patent: *May 7, 2013**

(54) SYSTEMS AND METHODS FOR PRODUCING A CRUDE PRODUCT

(75) Inventors: Bo Kou, Novato, CA (US); Shuwu Yang, Richmond, CA (US); Bruce Reynolds, Martinez, CA (US); Julie Chabot, Novato, CA (US)

(73) Assignee: Chevron U.S.A., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/103,790

(22) Filed: May 9, 2011

(65) Prior Publication Data

US 2011/0210045 A1 Sep. 1, 2011

Related U.S. Application Data

(63) Continuation-in-part of application No. 12/506,885, filed on Jul. 21, 2009, now Pat. No. 7,943,036, and a continuation-in-part of application No. 12/233,439, filed on Sep. 18, 2008, now Pat. No. 7,938,954, which is a continuation-in-part of application No. 11/410,826, filed on Apr. 24, 2006, now Pat. No. 7,708,877, which is a continuation-in-part of application No. 11/305,378, filed on Dec. 16, 2005, now Pat. No. 7,431,831, which is a continuation-in-part of application No. 11/303,427, filed on Dec. 16, 2005, now Pat. No. 7,431,822, which is a continuation-in-part of application No. 11/305,377, filed on Dec. 16, 2005, now Pat. No. 7,431, 823.

(60) Provisional application No. 61/483,862, filed on May 9, 2011.

(51) Int. Cl.
*C10G 65/10* (2006.01)

(52) U.S. Cl.
USPC ..... 208/59; 208/49; 208/56; 208/58; 208/112

(58) Field of Classification Search ..... 208/49, 208/56, 58–59, 112
See application file for complete search history.

(56) References Cited

U.S. PATENT DOCUMENTS 2,914,462 A 11/1959 Hemminger
3,166,493 A 1/1965 Harvey (Continued)

OTHER PUBLICATIONS

Hydrodesulfurization Catalysis by Transition Metal Sulfides by Pecoraro et al., Journal of Catalysis 67, 430-445 (1981).

(Continued)

*Primary Examiner* — Brian McCaig

(57) ABSTRACT

Systems and methods for hydroprocessing heavy oil feedstock is disclosed. The process employs a plurality of contacting zones and at least a separation zone to convert at least a portion of the heavy oil feedstock to lower boiling hydrocarbons, forming upgraded products. In one embodiment, water and/or steam being injected into at least a contacting zone. The contacting zones operate under hydrocracking conditions, employing at least a slurry catalyst. In one embodiment, at least a portion of the non-volatile fractions recovered from at least one of the separation zones is recycled back to at least a contacting zone ("recycled mode"). In one embodiment, the number of separation zones is less than the number of contacting zones in the system. In the separation zones, upgraded products are removed overhead and optionally treated in an in-line hydrotreater; and the bottom stream is optionally further treated in a fractionator.

32 Claims, 7 Drawing Sheets

U.S. PATENT DOCUMENTS 3,215,617 A 11/1965 Burch et al.
3,817,856 A 6/1974 Aaron et al.
4,111,787 A * 9/1978 Aldridge et al. ..... 208/413
4,259,294 A 3/1981 Van Zijll Langhout et al.
4,485,004 A 11/1984 Fisher et al.
4,523,986 A 6/1985 Seufert
4,591,426 A 5/1986 Krasuk et al.
4,592,827 A 6/1986 Galiasso et al.
4,612,109 A 9/1986 Dillon et al.
4,684,456 A 8/1987 Van Driesen et al.
4,710,486 A 12/1987 Lopez et al.
4,824,821 A 4/1989 Lopez et al.
4,943,547 A 7/1990 Seamans et al.
4,970,190 A 11/1990 Lopez et al.
5,039,392 A 8/1991 Bearden, Jr. et al.
5,041,404 A 8/1991 Seamans et al.
5,162,282 A 11/1992 Lopez et al.
5,164,075 A 11/1992 Lopez
5,178,749 A 1/1993 Lopez et al.
5,200,063 A * 4/1993 Neskora et al. ..... 208/400
5,298,152 A 3/1994 Kramer
5,371,308 A 12/1994 Gosselink et al.
5,374,348 A 12/1994 Sears et al.
5,484,755 A 1/1996 Lopez
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.
6,190,542 B1 2/2001 Comolli et al.
6,241,874 B1 6/2001 Wallace et al.
6,270,654 B1 8/2001 Colyar et al.
6,270,655 B1 8/2001 Ganguli
6,274,530 B1 8/2001 Cayton et al.
6,277,895 B1 8/2001 Zhou et al.
6,278,034 B1 8/2001 Espinoza et al.
6,291,391 B1 9/2001 MacArthur
6,299,760 B1 10/2001 Soled et al.
6,387,334 B1 5/2002 Krantz et al.
6,451,729 B1 9/2002 Song et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,214,309 B2 5/2007 Chen et al.
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
7,431,824 B2 10/2008 Chen et al.
7,897,035 B2 3/2011 Chabot
7,897,036 B2 3/2011 Chabot et al.
7,931,796 B2 4/2011 Chabot et al.
7,931,797 B2 4/2011 Chabot et al.
7,935,243 B2 5/2011 Chabot et al.
7,938,954 B2 5/2011 Chabot et al.
7,972,499 B2 7/2011 Chen et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori
2004/0163999 A1 8/2004 Plantenga et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott
2006/0207917 A1 9/2006 Domokos et al.
2006/0231465 A1 10/2006 Bhan
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0138059 A1 6/2007 Farshid et al.
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.
2008/0193345 A1* 8/2008 Lott et al. ..... 422/187
2009/0057195 A1* 3/2009 Powers et al. ..... 208/59

OTHER PUBLICATIONS

A review of zinc dialkyldithiophosphates (ZDDPS): characterization and role in the lubricating oil by Barnes et al., Tribology International 34 (2001) 389-395.

Petroleum residue upgrading with dispersed catalysts Part I. Catalysts activity and selectivity. Applied Catalysis A: General 204 (2000) 203-213.
Iron sulfide Catalysts for Coal Liquefaction Prepared Using a Micellar Technique by Chadha et al., Ind. Eng. Chem. Res. 1996. 35. 2916-2919.
Nickel, Cadium and Lead Sulfides as Catalysts in the Vapor Phase Reduction of Nitrobenzene by Brown et al., Laboratory of Physical Chemistry Indiana University Jul. 29, 1938.
Solution Synthesis of the unsupported Ni-W sulfide hytrotreating catalysts by Le et al., Catalysis Today 130 (2008) 24-31.
Thermal decomposition of sulfur comppunds. I. 2-Methyl-2-propanethiol by Thompson et al., Bureau of Mines Petroleum and Oil-Shale Experiment Station Nov. 19, 1951.
Hydroprocessing of heavy petroleum feeds: tutorial by Ancheyta et al. Catalysis today 109 (2005) 3-15.
A review of recent advances on process technologies for upgrading of heavy oils and residue by Rana et al., Fuel 86 (2007) 1216-1231.

* cited by examiner

SYSTEMS AND METHODS FOR PRODUCING A CRUDE PRODUCT

CROSS-REFERENCE TO RELATED APPLICATIONS

This application is a CIP of and claims priority to U.S. patent application Ser. No. 12/506,885 filed Jul. 21, 2009, now U.S. Pat. No. 7,943,036. This application is also a CIP of and claims priority to U.S. patent application Ser. No. 12/233,439 filed Sep. 18, 2008, now U.S. Pat. No. 7,938,954, which is a CIP of U.S. patent application Ser. No. 11/410,826 filed Apr. 24, 2006, now U.S. Pat. No. 7,708,877, which is a CIP of U.S. patent application Ser. No. 11/305,378 filed Dec. 16, 2005, now U.S. Pat. No. 7,431,831, which is a CIP of U.S. patent application Ser. No. 11/303,427 filed Dec. 16, 2005, now U.S. Pat. No. 7,431,822, which is a CIP of U.S. patent application Ser. No. 11/305,377, filed Dec. 16, 2005, now U.S. Pat. No. 7,431,823. This application also claims benefit under 35 USC 119 of U.S. Provisional Patent Application No. 61/483,862, with a filing date of May 9, 2011.

TECHNICAL FIELD

The invention relates to systems and methods for treating or upgrading heavy oil feeds, and crude products produced using such systems and methods.

BACKGROUND

The petroleum industry is increasingly turning to heavy oil feeds such as heavy crudes, resids, coals, tar sands, etc., as sources for feedstocks. These feedstocks are characterized by high concentrations of asphaltenes rich residues, and low API gravities, with some being as low as less than 0° API.

PCT Patent Publication No. WO2008/014947, US Patent Publication No. 2008/0083650, US Patent Publication No. 2005/0241993, US Patent Publication No. 2007/0138057, and U.S. Pat. No. 6,660,157 describe processes, systems, and catalysts for processing heavy oil feeds. Heavy oil feedstock typically contains large levels of heavy metals. Some of the heavy metals such as nickel and vanadium tend to react quickly, leading to deposition or trapping of vanadium-rich solids in equipment such as reactors. The solid deposition reduces available volume for reaction, cutting down on run time.

There is still a need for improved systems and methods to upgrade/treat process heavy oil feeds, particularly improved systems for better raw material utilization with less catalyst usage.

SUMMARY OF THE INVENTION

In one aspect, the invention relates to a process for hydroprocessing a heavy oil feedstock, the process employing a plurality of contacting zones and at least a separation zone, the process comprising: combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products; sending a mixture comprising the upgraded products, the slurry catalyst, the hydrogen containing gas, and unconverted heavy oil feedstock to a contacting zone other than the first contacting zone, which contacting zone is maintained under hydrocracking conditions with additional hydrogen containing gas feed to convert at least a portion of the heavy oil feedstock to lower boiling hydrocarbons, forming additional upgraded products; sending a mixture comprising the upgraded products, the slurry catalyst, the hydrogen containing gas, and unconverted heavy oil feedstock from the contacting zone other than the first contacting zone to at least a separation zone, whereby the upgraded products are removed with the hydrogen containing gas as an overhead stream, and the slurry catalyst and the unconverted heavy oil feedstock are removed as a non-volatile stream; and recycling at least a portion of the non-volatile stream to at least one of the contacting zones as a recycled catalyst stream, and wherein the recycled catalyst stream is between 3 to 50 wt. % of the heavy oil feedstock; and wherein the number of contacting zones is equal or greater than the number of separation zone(s) in operation.

In one aspect, the invention relates to a process for hydroprocessing a heavy oil feedstock, the process employs a plurality of contacting zones and at least a separation zone, the process comprising: providing a hydrogen containing gas feed; providing a slurry catalyst comprising an active catalyst in a hydrocarbon oil diluent; combining at least a portion of the hydrogen containing gas feed, at least a portion of the heavy oil feedstock, and at least a portion of the slurry catalyst in a first contacting zone under hydrocracking conditions at a sufficient temperature and a sufficient pressure to convert at least a portion of the heavy oil feedstock to lower boiling hydrocarbons, forming upgraded products; sending a first effluent stream from the first contacting zone comprising a mixture of the upgraded products, the slurry catalyst, the hydrogen containing gas, and unconverted heavy oil feedstock as a feed to a first separation zone, wherein volatile upgraded products are removed with the hydrogen containing gas as a first overhead stream, and the slurry catalyst, heavier hydrocracked liquid products, and the unconverted heavy oil feedstock are removed as a first non-volatile stream; wherein the plurality of contacting zones and separation zones are configured in a permutable fashion for the plurality of contacting zones and separation zones to operate in: a sequential mode; a parallel mode; a combination of parallel and sequential mode; all online; some online and some on stand-by; some online and some off-line; a parallel mode with the effluent stream from the contacting zone being sent to at least a separation zone in series with the contacting zone; a parallel mode with the effluent stream from the contacting zone being combined with an effluent stream from at least another contacting zone and sent to the separation zone; and combinations thereof.

In another aspect, the invention relates to a process for hydroprocessing a heavy oil feedstock, the process employing a plurality of contacting zones and at least a separation zone, including a first contacting zone and a contacting zone other than the first contacting zone, the process comprising: providing a hydrogen containing gas feed; providing a heavy oil feedstock; providing a slurry catalyst feed comprising an active metal catalyst having an average particle size of at least 1 micron in a hydrocarbon oil diluent, at a concentration of greater than 500 wppm of active metal catalyst to heavy oil feedstock; combining at least a portion of the hydrogen containing gas feed, at least a portion of the heavy oil feedstock, and at least a portion of the slurry catalyst feed in a first contacting zone under hydrocracking conditions to convert at least a portion of the first heavy oil feedstock to lower boiling hydrocarbons, forming upgraded products; sending a first effluent stream from the first contacting zone comprising the upgraded products, the slurry catalyst, the hydrogen containing gas, and unconverted heavy oil feedstock to a first separation zone, wherein volatile upgraded products are removed with the hydrogen containing gas as a first overhead stream, and the slurry catalyst, heavier hydrocracked liquid products, and the unconverted heavy oil feedstock are separated and removed as a first non-volatile stream, wherein the first non-volatile stream contains less than 30% solid; collecting the first overhead stream for further processing in a product purification unit; and collecting the first non-volatile streams for further processing including slurry catalyst separation and recovery, wherein the slurry catalyst is separated from the unconverted heavy oil feedstock and the heavier hydrocracked liquid products and recovered.

In a third aspect, the invention relates to a process for hydroprocessing a heavy oil feedstock, the process employing a plurality of contacting zones and at least a separation zone, including a first contacting zone and a contacting zone other than the first contacting zone, the process comprising: providing a hydrogen containing gas feed; providing a heavy oil feedstock; providing at least an additive material selected from inhibitor additives, anti-foam agents, stabilizers, metal scavengers, metal contaminant removers, metal passivators, and sacrificial materials, in an amount of less than 1 wt. % of the heavy oil feedstock; providing a slurry catalyst feed comprising an active metal catalyst having an average particle size of at least 1 micron in a hydrocarbon oil diluent; combining at least a portion of the hydrogen containing gas feed, at least a portion of the heavy oil feedstock, at least a portion of the additive material, and at least a portion of the slurry catalyst feed in a first contacting zone under hydrocracking conditions to convert at least a portion of the first heavy oil feedstock to lower boiling hydrocarbons, forming upgraded products; sending a first effluent stream from the first contacting zone to a first separation zone, wherein volatile upgraded products are removed with the hydrogen containing gas as a first overhead stream, and the slurry catalyst, heavier hydrocracked liquid products, and unconverted heavy oil feedstock are separated and removed as a first non-volatile stream, wherein the first non-volatile stream contains less than 30% solid; collecting the first overhead stream for further processing in a product purification unit; and collecting the first non-volatile stream for further processing in a catalyst recovery unit.

In yet another aspect, the invention relates to a process for a process for hydroprocessing a heavy oil feedstock, the process employing a plurality of contacting zones and at least a separation zone, the process comprising: providing a hydrogen containing gas feed; providing a heavy oil feedstock; providing a slurry catalyst feed comprising an active metal catalyst having an average particle size of at least 1 micron in a hydrocarbon oil diluent; combining at least a portion of the hydrogen containing gas feed, at least a portion of the heavy oil feedstock, and at least a portion of the slurry catalyst feed in a first contacting zone under hydrocracking conditions, operating at a first pressure, to convert at least a portion of the first heavy oil feedstock to lower boiling hydrocarbons, forming upgraded products; sending a first effluent stream from the first contacting zone to a first separation zone having an entry pressure of most 100 psi less than the first pressure, wherein volatile upgraded products are removed with the hydrogen containing gas as a first overhead stream, and the slurry catalyst, heavier hydrocracked liquid products, and unconverted heavy oil feedstock are removed as a first non-volatile stream, wherein the first non-volatile stream contains less than 30% solid; collecting the first overhead stream for further processing in a product purification unit; and collecting the first non-volatile stream for further processing in a catalyst recovery unit.

DETAILED DESCRIPTION

Figure 1:
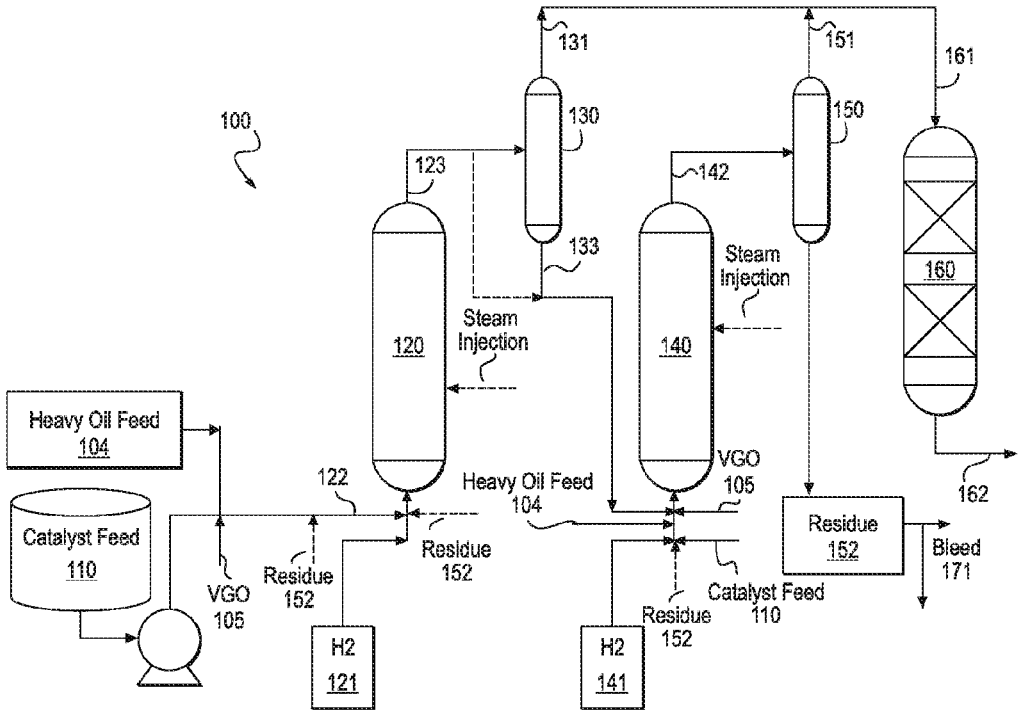
FIG. 1 is a flow diagram that schematically illustrates various embodiments of an upgrade system with two contacting zones running in sequential mode (series), including embodiments with recycle and/or water injection.

The present invention relates to an improved system to treat or upgrade heavy oil feeds, particularly heavy oil feedstock having high levels of heavy metals.

The following terms will be used throughout the specification and will have the following meanings unless otherwise indicated.

"Heavy oil" feed or feedstock refers to heavy and ultra-heavy crudes, including but not limited to resids, coals, bitumen, shale oils, tar sands, etc. Heavy oil feedstock may be liquid, semi-solid, and/or solid. Examples of heavy oil feedstock that might be upgraded as described herein include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include bottom of the barrel and residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch" and "vacuum residue"—which have a boiling point of 524° C. (975° F.) or greater.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity of from −5 to +5.

In one embodiment, the heavy oil feedstock comprises Athabasca bitumen (Canada) having at least 50% by volume vacuum resid. In another embodiment, the feedstock is a Boscan (Venezuela) feed with at least 64% by volume vacuum residue. In one embodiment, the heavy oil feedstock contains at least 100 ppm V (per gram of heavy oil feedstock). In another embodiment, the V level ranges between 500 and 1000 ppm. In a third embodiment, at least 2000 ppm.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing". Hydroprocessing is meant as any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

Hydrogen refers to hydrogen, and/or a compound or compounds that when in the presence of a heavy oil feed and a catalyst react to provide hydrogen.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

"Catalyst feed" includes any catalyst suitable for upgrading heavy oil feed stocks, e.g., one or more bulk catalysts and/or one or more catalysts on a support. In one embodiment, the catalyst feed is in the form of a slurry catalyst.

"Bulk catalyst" may be used interchangeably with "unsupported catalyst," meaning that the catalyst composition is NOT of the conventional catalyst form which has, e.g., having a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

"Catalyst precursor" refers to a compound containing one or more catalytically active metals, from which compound a catalyst is eventually formed. It should be noted that a catalyst precursor may be catalytically active as a hydroprocessing catalyst. "Catalyst precursor" may be referred herein as "catalyst" when used in the context of a catalyst feed.

"Fresh catalyst" refers to a catalyst or a catalyst precursor that has not been used in a reactor in a hydroprocessing operation. The term fresh catalyst herein also includes "regenerated" or "rehabilitated" catalysts, e.g., catalyst that has been used in at least a reactor in a hydroprocessing operation ("used catalyst") but its catalytic activity has been restored or at least increased to a level well above the used catalytic activity level. The term "fresh catalyst" may be used interchangeably with "fresh slurry catalyst".

"Slurry catalyst" (or sometimes referred to as "slurry", or "dispersed catalyst") refers to a liquid medium, e.g., oil, water, or mixtures thereof, in which catalyst and/or catalyst precursor particles (aggregates, particulates or crystallites) are dispersed within. The term slurry catalyst refers to a fresh catalyst, or a catalyst that has been used in heavy oil upgrading and with diminished activity (not a fresh catalyst).

In one embodiment, the slurry catalyst feed stream contains a fresh catalyst in a medium (diluent). In another embodiment, the slurry catalyst feed contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment. In one embodiment, the medium (or diluent) is a hydrocarbon oil diluent. In another embodiment, the liquid medium is the heavy oil feedstock itself In yet another embodiment, the liquid medium is a hydrocarbon oil other than the heavy oil feedstock, e.g., a VGO medium or diluent.

The term "contacting zone" refers to an equipment in which the heavy oil feed is treated or upgraded by contact with a slurry catalyst feed in the presence of hydrogen. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

The term "front-end contacting zone" (or the "first contacting zone") means the $1^{st}$ reactor in a system with a plurality of contacting zones operating in sequential mode (series). In one embodiment of a system with at least three contacting zones, the first front-end contacting zone may include both first and second reactors. In another embodiment, the first contacting zone means the $1^{st}$ reactor only.

In one embodiment, the upgrade process comprises a plurality of reactors, employed as contacting zones, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing over 70% of the sulfur, over 90% of nitrogen, and over 90% of the heteroatoms in the crude product being processed.

The term "separation zone" refers to an equipment in which the effluent stream from a contacting zone is either fed directly into, or subjected to one or more intermediate processes and then fed directly into the separation zone, which is a high pressure high temperature flash drum or flash separator, wherein gases and volatile liquids are separated from the non-volatile fraction. The "separation zone" in one embodiment refers to an ISF ("interstage flash separator") if it is located in between two contacting zones. The term separating zone in one embodiment refers to a plurality of separators in series, e.g., one separator operated at high pressure followed by another separator operated at a lower pressure. As used herein, high pressure as refers to a separation zone means a pressure of at least 1500 psi, e.g., between 1500-3000 psi. Medium pressure refers to a pressure of less than 800 psi, and greater than 200 psi, e.g., in the range of 300-700 psi in one embodiment. Low pressure means less than 100 psi. With respect to operating temperatures, a high temperature means at least 600° F., e.g., between 650 to 850° F. A medium temperature means the separation zone operates at 400 to 600° F. A low temperature means 100 to 300° F., in one embodiment, in the range of 100 to 250° F.

In one embodiment, the non-volatile fraction stream comprises unconverted heavy oil feed, a small amount of heavier hydrocracked liquid products (synthetic or less-volatile/non-volatile upgraded products), the slurry catalyst and any entrained solids (asphaltenes, coke, etc.). In one embodiment, the separation zone provides a pressure drop from one contacting zone to the next one in series. The pressure drop induces by the separation zone allows the gas and volatile liquids to be separated from the non-volatile fraction.

In one embodiment with at least an interstage flash separator (ISF), at least one of the ISFs operates in full ISF mode, i.e., wherein all the vapor effluent from the preceding contacting zone is removed as overhead of the ISF. The ISF in this embodiment is maintained with at least some liquid level. Entrained liquid and solid (slurry catalyst) from the preceding contacting zone exits the ISF as a bottom stream.

In another embodiment with at least an interstage flash separator (ISF), at least one of the ISFs operates in partial vapor removal mode, i.e., wherein part of the vapor effluent from the preceding contacting zone is removed as overhead of the ISF. The ISF in this embodiment is maintained mostly liquid free (vapor filled). In one embodiment, there is no level control system. The amount of vapor effluent removed in one embodiment ranges from 5 to 95%, 10-70% in a second embodiment, and 20 to 50% in a third embodiment.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fractions exit the side or bottom of the equipment with the slurry catalyst and entrained solid fraction, if any.

In one embodiment, the upgrade system comprises a single reactor followed by a separator. In another embodiment, the system comprises a plurality of contacting zones and a plurality of separating zones, with at least a separating zone positioned to operate in series for each contacting zone, i.e., the number of (operating) contacting zones to be the same as the number of (operating) separation zones. In yet another embodiment, the upgrade system comprises a plurality of reactors and at least a separator, with the number of (operating) separation zones to be less than the number of (operating) contacting zones, with at least two contacting zones (reactors) operating in series (without a separating zone or ISF in operation in between the reactors). In a fourth embodiment, the system comprises at least two reactors operating in series and at least one separator, wherein the at least a separator being positioned right after the last reactor in series.

In one embodiment, the upgrade system comprises a plurality of reactors in series operating as a single train. In another embodiment, a parallel train with a plurality of reactors. In a third embodiment, a plurality of reactors configured in combination of parallel and series operations.

In one embodiment, the upgrade system may comprise a combination of reactors and separators in series with multi-stage reactor-separators, with a solvent deasphalting (SDA) unit being positioned as an interstage treatment system between any two reactors in series, or before the first reactor in the series.

In one embodiment, the system further comprises a series of separating zones and/or a fractionator for further processing of the bottom effluent from the last separating zone (the non-volatile stream, also referred to as STB or "stripper bottoms" product), e.g., a bleed stream, for further processing. The fractionator in one embodiment extracts and separates lighter products from the spent slurry catalyst in the non-volatile stream, lessening the load on a downstream de-oiling unit.

In one embodiment, the upgrade system operates in once-through mode, wherein the slurry catalyst and heavy oil feedstock flow through the contacting zone(s) once, instead of being recycled or recirculated around the system as in the prior art. In the once-through upgrade system, virtually none of the unconverted material and slurry catalyst mixture is recycled back to the 1$^{st}$ (or previous) contacting zone or reactor in the series. In the once-through mode, the non-volatile materials from the last separation zone in the upgrade system, comprising unconverted materials, heavier hydrocracked liquid products (synthetic products or non-volatile/less-volatile upgraded products), slurry catalyst, small amounts of coke, asphaltenes, etc., are sent off-site for further processing/regeneration of the catalyst, or to a deoiling unit to separate the spent catalyst from the hydrocarbons, and subsequently to a metal recovery unit to recover precious metals from the spent catalyst.

In another embodiment, the upgrade system operates in "recycled" mode, wherein at least a portion of the non-volatile materials from the last separation zone in the upgrade system is recycled to at least one of the contacting zones as part of the feed. Depending on the final heavy oil upgrade conversion, the amount of recycled stream ranges from 2 to 50 wt. % of the heavy oil feed to the system in one embodiment; from 3 to 25 wt. % in a second embodiment; and 5 to 15 wt. % in a third embodiment. In the recycled mode, at least a portion of the non-volatile materials from the last separation zone is removed as a bleed stream. In one embodiment, the bleed stream ranges in an amount of 1 to 50 wt. % of total heavy oil feed to the system. In another embodiment, the bleed amount ranges from 3 to 35 wt. %. In a third embodiment, from 5 to 20 wt. %. The amount of bleed stream removed can be varied depending on the operating conditions, e.g., conversion rate and time into operation. In one embodiment, a sufficient amount of bleed stream is removed for a conversion rate of at least 90%. In a second embodiment, a sufficient amount is removed for a conversion rate of at least 95%. The bleed stream can be sent off-site for processing, or to a deoiling/metal recovery unit, or to a fractionator for further removal of lighter products, prior to being sent off-site or to a deoiling unit.

In one embodiment, the upgrade system is configured for flexible operation, allowing different operating modes, e.g., running in parallel (tandem) to running in series (sequential) with different combinations of reactors/flash separators, running in recycled mode to running in once-through mode (with little or no recycle), and combinations thereof.

Process Conditions: In one embodiment, the upgrade system is maintained under hydrocracking conditions, e.g., at a minimum temperature to effect hydrocracking of a heavy oil feedstock. In one embodiment, the system operates at a temperature ranging from 400° C. (752° F.) to 600° C. (1112° F.), and a pressure ranging from 10 MPa (1450 psi) to 25 MPa (3625 psi). In one embodiment, the process condition being controlled to be more or less uniformly across the contacting zones. In another embodiment, the condition varies between the contacting zones for upgrade products with specific properties.

In one embodiment, the contacting zone process temperature ranges from about 400° C. (752° F.) to about 600° C. (1112° F.), less than 500° C. (932° F.) in another embodiment, and greater than 425° C. (797° F.) in another embodiment. In one embodiment, the system operates with a temperature difference between the inlet and outlet of a contacting zone ranging from 5 to 50° F.

The temperature of the separation zone is maintained within ±90° F. (about ±50° C.) of the contacting zone temperature in one embodiment, within ±70° F. (about ±38.9° C.) in a second embodiment, within ±15° F. (about ±8.3° C.) in a third embodiment, and within ±5° F. (about ±2.8° C.) in a fourth embodiment. In one embodiment, the temperature difference between the last separation zone and the immediately preceding contacting zone is within ±50° F. (about ±28° C.).

The process pressure in the contacting zones ranges from about 10 MPa (1,450 psi) to about 25 MPa (3,625 psi) in one embodiment, about 15 MPa (2,175 psi) to about 20 MPa (2,900 psi) in a second embodiment, less than 22 MPa (3,190 psi) in a third embodiment, and more than 14 MPa (2,030 psi) in a fourth embodiment.

In one embodiment, the liquid hourly space velocity (LHSV) of the heavy oil feed in each of the contacting zones generally ranges from about 0.075 $h^{-1}$ to about 2 $h^{-1}$ in one embodiment; about 0.1 $h.^{-1}$ to about 1.5 $h^{-1}$ in a second embodiment, about 0.15 $h^{-1}$ to about 1.75 $h^{-1}$ in a third embodiment, about 0.2 $h^{-1}$ to about 1 $h^{-1}$ in a fourth embodiment, and about 0.2 $h^{-1}$ to about 0.5 $h^{-1}$ in a fifth embodiment In one embodiments, LHSV is at least 0.1 $h^{-1}$. In another embodiment, the LHSV is less than 0.3 $h^{-1}$. In one embodiment of a once-through process, it operates at a higher throughput rate as compared to a recycled upgrade system.

In one embodiment, the contacting zone comprises a single reactor or plurality of reactors in series, providing a total residence time ranging from 0.1 to 15 hours. In a second embodiment, the resident time ranges from 0.5 to 5 hrs. In a third embodiment, the total residence time in the contacting zone ranges from 0.2 to 2 hours.

In one embodiment, the system further comprises an additional separating zone after the last high temperature high pressure separating zone for further treatment of the STB. The additional separating zone in one embodiment is a medium or low pressure, high (or medium) temperature (MPHT/LPHT) separator (e.g., 100-600 psig and 400-800° F.). The bottom stream from the MPHT/LPHT separator can be directed to a fractionator operating at a relatively low pressure (e.g., less than 100 psig in one embodiment, in the range of 10-75 psig in another embodiment) to further remove lighter products from the STB, for a more concentrated bottom stream which can be sent to a catalyst deoiling unit for further treatment and subsequent metal recovery.

Minimizing Pressure Drop: In the prior art, it is disclosed that with a higher pressure drop in a heavy oil upgrade system, i.e., a pressure drop upon entering the separation zone of up to 1000 psi and preferably in the range of 300 to 700 psi, lighter boiling materials can be more easily separated/removed from the upgrade system via the separation zone. A high pressure drop can be induced with the introduction of pressure reducing devices. However, an upgrade system with a higher pressure drop is found to be operationally unstable, particularly with frequent plugging due to deposit in equipment and/or common valve operating problems including failure to open at set pressure due to plugging of the valve inlet or outlet, corrosion, or erosion of valves.

In one embodiment, the upgrade system is configured for optimal operation, e.g., efficiency with much less downtime due to equipment plugging compared to the prior art with less than 100 psi pressure drop. The optimal efficiency is obtained in one embodiment with minimal pressure drop in the system, wherein the pressure of the separation zone is maintained within ±10 to ±100 psi of the preceding contacting zone in one embodiment, within ±20 to ±75 psi in a second embodiment, and within ±50 to ±100 psi in a third embodiment. As used here, the pressure drop refers to the difference between the exit pressure of the preceding contacting zone X and the entry pressure of the separation Y, with (X−Y) being less than 100 psi.

Optimal efficiency can also be obtained with minimal pressure from one contacting zone to the next contacting zone for a system operating sequentially, with the pressure drop being maintained to be 100 psi or less in one embodiment, and 75 psi or less in a second embodiment, and less than 50 psi in a third embodiment. The pressure drop herein refers to the difference between the exit pressure of one contacting zone and the entry pressure of the next contacting zone.

In one embodiment, the contacting zone is in direct fluid communication to the next separation zone or contacting zone for a minimum pressure drop. As used herein, direct fluid communication means that there is free flow from the contacting zone to the next separation zone (or the next contacting zone) in series, with no flow restriction. In one embodiment, direct fluid communication is obtained with no flow restriction due to presence of valves, orifices (or a similar device), or changes in pipe diameter.

In one embodiment, the minimal pressure drop from the contacting zone to the next separation zone or contacting zone (upon entering the separating zone or the contacting zone) is due to piping components, e.g., elbows, bends, tees in the line, etc., and not due to the use of pressure reducing device such as valves, control valves, etc. to induce the pressure drop as in the prior art. In the prior art, it is taught that the separation zone functions as an interstage pressure differential separator.

In one embodiment, the minimal pressure drop is induced by friction loss, wall drag, volume increase, and changes in height as the effluent flows from the contacting zone to the next equipment in series. If valves are used in the once through system, the valves are selected/configured such that the pressure drop from one equipment, e.g., the contacting zone, to the next piece of equipment is kept to be at 100 psi or lower.

Hydrogen Feed: In one embodiment, a hydrogen source is provided to the process. The hydrogen can also be added to the heavy oil feed prior to entering the preheater, or after the preheater. In one embodiment, the hydrogen feed enters the contacting zone co-currently with the heavy oil feed in the same conduit. In another embodiment, the hydrogen source may be added to the contacting zone in a direction that is counter to the flow of the feed. In a third embodiment, the hydrogen enters the contacting zone via a gas conduit separately from the combined heavy oil and slurry catalyst feed stream. In a fourth embodiment, the hydrogen feed is introduced directly to the combined catalyst and heavy oil feedstock prior to being introduced into the contacting zone. In yet another embodiment, the hydrogen gas and the combined heavy oil and catalyst feed are introduced at the bottom of the reactor as separate streams. In yet another embodiment, hydrogen gas can be fed into several sections of/locations on the contacting zone.

In one embodiment, the hydrogen source is provided to the process at a rate (based on ratio of the gaseous hydrogen source to the heavy oil feed) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl).

In one embodiment, some of the hydrogen (25-75%) is supplied to the first contacting zone, and the rest is added as supplemental hydrogen to other contacting zones in the system.

The hydrogen source, in some embodiments, is combined with carrier gas(es) and recirculated through the contacting zone. Carrier gas may be, for example, nitrogen, helium, and/or argon. The carrier gas may facilitate flow of the heavy oil feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

Catalyst Feed: In one embodiment for an upgrade system running in sequential mode (whether operating in once-through mode or recycled mode), all of the slurry catalyst feed is provided to the first contacting zone. In other embodiments of the sequential mode, at least a portion of the catalyst feed is "split" or diverted to at least one other contacting zones in the system (other than the first contacting zone). In one embodiment for an upgrade process with the contacting zones running in tandem (parallel)—whether operating in once-through mode or recycled mode, all the contacting zones in operation receive a slurry catalyst feed (along with a heavy oil feed).

In one embodiment, "at least a portion" means at least 10% of the catalyst feed. In another embodiment, at least 20%. In a third embodiment, at least 40%. In a fourth embodiment, at least 50% of the catalyst feed is diverted to at least a contacting zone other than the first one.

In one embodiment of a sequential operation, less than 60% of the catalyst feed is fed to the first contacting zone in the system, with 40% or more of the fresh catalyst being diverted to the other contacting zone(s) in the system. In another embodiment, the catalyst feed is being equally split between the contacting zones in the system. In one embodiment, at least a portion of the fresh catalyst feed is sent to at least one of the intermediate contacting zones and/or the last contacting zone in the system.

In yet another embodiment, the process is configured for a flexible catalyst feed scheme such that the catalyst feed can sometimes be fed at full rate (100% of the required catalyst rate) to the first reactor in the system for a certain period of time, then split equally or according to pre-determined proportions to all of the reactors in the system for a pre-determined amount of time, or split according to pre-determined proportions for the catalyst feed to be fed to the different reactors at different concentrations.

The slurry catalyst feed used herein may comprise one or more different slurry catalysts as a single catalyst feed stream or separate feed streams. In one embodiment, a single fresh catalyst feed stream is supplied to the contacting zones. In another embodiment, the fresh catalyst feed comprises multiple and different catalyst types, with a certain catalyst type going to one or more contacting zones (e.g., the first contacting zone in the system) as a separate stream, and a different slurry catalyst going to contacting zone(s) other than the $1^{st}$ contacting zone in the system as a different catalyst stream.

In one embodiment, sending different catalysts to the front end and back end contacting zones can be useful in mitigating the vanadium trapping issue and sustain the overall upgrade performance. In one embodiment, a Ni-only or a NiMo sulfide slurry catalyst rich in Ni is sent to the front end reactor to help reduce vanadium trapping in the system, while a different catalyst, e.g., Mo sulfide or a NiMo sulfide catalyst rich in Mo, can be injected into the back end reactor(s) to maintain an overall high conversion rate, improve product quality and possibly reduce the gas yield in one embodiment. As used herein, a slurry catalyst rich in Ni means that the Ni/Mo ratio is greater than 0.15 (as wt. %) Conversely, a slurry catalyst rich in Mo means that the Ni/Mo ratio is less than 0.05 (as wt. %).

In one embodiment, the slurry catalyst feed is first preconditioned before entering one of the contacting zones, or before being brought into contact with the heavy oil feed before entering the contacting zones. In one example, the catalyst enters into a preconditioning unit along with hydrogen at a rate from 500 to 7500 SCF/BBL (BBL here refers to the total volume of heavy oil feed to the system). It is believed that instead of bringing a cold catalyst in contact with the heavy oil feed, the preconditioning step helps with the hydrogen adsorption into the active catalyst sites, and ultimately the conversion rate. In one embodiment in the precondition unit, the slurry catalyst/hydrogen mixture is heated to a temperature between 300° F. to 1000° F. (149 to 538° C.). In another embodiment, the catalyst is preconditioned in hydrogen at a temperature of 500 to 725° F. (260 to 385° C.). In yet another embodiment, the mixture is heated under a pressure of 300 to 3200 psi in one embodiment; 500-3000 psi in a second embodiment; and 600-2500 psi in a third embodiment.

Slurry Catalysts: The slurry catalyst comprises an active catalyst in a hydrocarbon oil diluent. In one embodiment, the catalyst is a sulfided catalyst comprising at least a Group VIB metal, or at least a Group VIII metal, or at least a group IIB metal, e.g., a ferric sulfide catalyst, zinc sulfide, nickel sulfide, molybdenum sulfide, or an iron zinc sulfide catalyst. In another embodiment, the catalyst is a multi-metallic catalyst comprising at least a Group VIB metal and at least a Group VIII metal (as a promoter), wherein the metals may be in elemental form or in the form of a compound of the metal. In one example, the catalyst is a $MoS_2$ catalyst promoted with at least a group VIII metal compound.

In one embodiment, the catalyst is a bulk multi-metallic catalyst comprising at least one Group VIII non-noble metal and at least two Group VIB metals, and wherein the ratio of the at least two Group VIB metals to the Group VIII non-noble metal is from about 10:1 to about 1:10. In another embodiment, the catalyst is of the formula $(M^t)_a(X^u)_b(S^v)_d(C^w)_e(H^x)_f(O^y)_g(N^z))_h$, wherein M represents at least one group VIB metal, such as Mo, W, etc. or a combination thereof; and X functions as a promoter metal, representing at least one of: a non-noble Group VIII metal such as Ni, Co; a Group VIII metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11(a+b). H is hydrogen with the value off ranging from 0 to 7(a+b). O represents oxygen with the value of g ranging from 0 to 5(a+b); and N represents nitrogen with h having a value of 0 to 0.5(a+b). In one embodiment, subscript b has a value of 0, for a single metallic component catalyst, e.g., Mo only catalyst (no promoter).

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VIII metals such as Mo, Co, W, etc. such as molybdenum naphthanate, vanadium naphthanate, vanadium octoate, molybdenum hexacarbonyl, and vanadium hexacarbonyl.

In one embodiment, the slurry catalyst has an average particle size of at least 1 micron. In another embodiment, the slurry catalyst has an average particle size in the range of 1-20 microns. In a third embodiment, the slurry catalyst has an average particle size in the range of 2-10 microns. In one embodiment, the slurry catalyst particle comprises aggregates of catalyst molecules and/or extremely small particles that are colloidal in size (e.g., less than 100 nm, less than about 10 nm, less than about 5 nm, and less than about 1 nm). In yet another embodiment, the catalyst particle comprises aggregates of single layer $MoS_2$ clusters of nanometer sizes, e.g., 5-10 nm on edge. In operations, the colloidal/nanometer sized particles aggregate in a hydrocarbon diluent, forming a slurry catalyst with an average particle size in the range of 1-20 microns.

In one embodiment, a sufficient amount of slurry catalyst is fed to the contacting zone(s) for each contacting zone to have a slurry (solid) catalyst concentration of at least 500 wppm to 3 wt. % (catalyst metal to heavy oil ratio).

In one embodiment for a conversion of at least 75% from heavy oil feedstock to less than 1000° F. (538° C.) boiling point materials at a high through put of at least 0.15 LHSV, the amount of catalyst feed into the contacting zone(s) ranges from 500 to 7500 wppm of the catalyst metal in heavy oil feed. In a second embodiment, the concentration of the fresh catalyst feed ranges from 750 to 5000 wppm catalyst metal. In a third embodiment, from 1000 to 3000 wppm. In a fourth embodiment, the concentration is less than 3000 wppm. In a fifth embodiment, the concentration is at least 1200 ppm. Catalyst metal refers to the active metal in the catalyst, e.g., for a NiMo sulfide slurry catalyst in which Ni is used as a promoter, the catalyst metal herein refers to the Mo concentration.

In one embodiment, it is conceivable to use less catalyst for the upgrade system, e.g., less than 500 ppm or even less than 200 ppm or 100 ppm. However, this will result in very poor/undesirable conversion rate of less than 50% in one embodiment, and even less than 10% in a second embodiment. The low catalyst level further results in unstable operations, e.g., letdown, coking, plugging, etc. with unconverted heavy oil in the equipment, particularly the reactors.

Optional Treatment System—SDA: In one embodiment, a solvent deasphalting unit (SDA) is employed before the first contacting zone to pre-treat the heavy oil feedstock. In yet another embodiment, the SDA is employed as an intermediate unit located after one of the intermediate separation zones. SDA units are typically used in refineries to extract incremental lighter hydrocarbons from a heavy hydrocarbon stream, whereby the extracted oil is typically called deasphalted oil (DAO), while leaving a residue stream behind that is more concentrated in heavy molecules and heteroatoms, typically known as SDA Tar, SDA Bottoms, etc. The SDA can be a separate unit or a unit integrated into the upgrade system.

Various solvents may be used in the SDA, ranging from propanes to hexanes, depending on the desired level of deasphalting prior to feeding the contact zone. In one embodiment, the SDA is configured to produce a deasphalted oil (DAO) for blending with the catalyst feed or feeding directly into the contacting zones instead of, or in addition to the heavy oil feed. As such, the solvent type and operating conditions can be optimized such that a high volume and acceptable quality DAO is produced and fed to the contacting zone. In this embodiment, a suitable solvent to be used includes, but not limited to hexane or similar C6+ solvent for a low volume SDA Tar and high volume DAO. This scheme would allow for the vast majority of the heavy oil feed to be upgraded in the subsequent contacting zone, while the very heaviest, bottom of the barrel bottoms that does not yield favorable incremental conversion economics due to the massive hydrogen addition requirement, to be used in some other manner.

In one embodiment, all of the heavy oil feed is pre-treated in the SDA and the DAO product is fed into the first contacting zone, or fed according to a split feed scheme with at least a portion going to a contacting zone other than the first in the series. In another embodiment, some of the heavy oil feed (depending on the source) is first pre-treated in the SDA and some of the feedstock is fed directly into the contacting zone(s) untreated. In yet another embodiment, the DAO is combined with the untreated heavy oil feedstock as one feed stream to the contacting zone(s). In another embodiment, the DAO and the untreated heavy oil feedstock are fed to the system as in separate feed conduits, with the DAO going to one or more of the contacting zones and the untreated heavy oil feed going to one or more of the same or different contacting zones.

In an embodiment wherein the SDA is employed as an intermediate unit, the non-volatile fraction comprising the slurry catalyst and optionally minimum quantities of coke/asphaltenes, etc. from at least one of the separation zones is sent to the SDA for treatment. From the SDA unit, the DAO is sent to at least one of the contacting zones as a feed stream by itself, in combination with a heavy oil feedstock as a feed, or in combination with the bottom stream from one of the separation zones as a feed. The DAO Bottoms comprising asphaltenes are sent away to recover metal in any carry-over slurry catalyst, or for applications requiring asphaltenes, e.g., blended to fuel oil, used in asphalt, or utilized in some other applications.

In one embodiment, the quality of the DAO and DAO Bottoms is varied by adjusting the solvent used and the desired recovery of DAO relative to the heavy oil feed. In an optional pretreatment unit such as the SDA, the more DAO oil that is recovered, the poorer the overall quality of the DAO, and the poorer the overall quality of the DAO Bottoms. With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

Heavy Oil Feed: The heavy oil feed here herein may comprise one or more different heavy oil feeds from different sources as a single feed stream, or as separate heavy oil feed streams. In one embodiment, a single heavy oil conduit pipe goes to all the contacting zones. In another embodiment, multiple heavy oil conduits are employed to supply the heavy oil feed to the different contacting zones, with some heavy oil feed stream(s) going to one or more contacting zones, and other heavy oil feed stream(s) going to one or more different contacting zones.

In some embodiments, at least a portion of the heavy oil feed (to be upgraded) is "split" or diverted to at least one other contacting zones (other than the first contacting zone), or to a SDA unit prior to being fed into a contacting zone. In one embodiment of a sequential operation, less than 90% of the unconverted heavy oil feed is fed to the first reactor in the system, with 10% or more of the unconverted heavy oil feed being diverted to the other contacting zone(s) in the system. In another embodiment of a tandem operation, the heavy oil feed is being equally split between the contacting zones in the system. In yet another embodiment, less than 80% of the unconverted heavy oil feed is fed to the first contacting zone in the system, and the remaining heavy oil feed is diverted to the last contacting zone in the system. In a fourth embodiment, less than 60% of the heavy oil feed is fed to the first contacting zone in the system, and the remainder of the unconverted heavy oil feed is equally split between the other contacting zones in the system.

In one embodiment, the heavy oil feedstock is preheated prior to being blended with the slurry catalyst feed stream(s). In another embodiment, the blend of heavy oil feedstock and slurry catalyst feed is preheated to create a feedstock that is sufficiently of low viscosity to allow good mixing of the catalyst into the feedstock. In one embodiment, the preheating is conducted at a temperature that is at least about 100° C. (212° F.) less than the hydrocracking temperature within the contacting zone. In another embodiment, the preheating is at a temperature that is about at least 50° C. less than the hydrocracking temperature within the contacting zone. In a third embodiment, the preheating of the heavy oil feedstock and/or a mixture of heavy oil feedstock and slurry catalyst is at a temperature of 500-700° F. (260-371° C.).

Optional Additive—Anti-foam Injection: In one embodiment, at least an anti-foam agent is injected to at least a contacting zone in the system to minimize the amount of foam and enable full utilization of the reaction zone. As used herein, the term anti-foam includes both anti-foam and defoamer materials, for preventing foam from happening and/or reducing the extent of foaming. Additionally, some anti-foam material may have both functions, e.g., reducing/mitigating foaming under certain conditions, and preventing foam from happening under other operating conditions.

Anti-foam agents can be selected from a wide range of commercially available products such as the silicones, e.g., polydimethyl siloxane (PDMS), polydiphenyl siloxane, fluorinated siloxane, etc., in an amount of 1 to 500 ppm of the heavy oil feedstock. In one embodiment, a high molecular PDMS is used, e.g., with a viscosity of over 60,000 cSt in one embodiment, over 100,000 cSt in another embodiment, and over 600,000 cSt in a third embodiment. It is believed that a higher viscosity (higher molecular weight) anti-foam agent decomposes more slowly and less prone to catalyst poisoning due to Si contamination.

In one embodiment, the anti-foam agent is added to a hydrocarbon solvent such as kerosene, which reduces the viscosity of the anti-foam and makes it pumpable. In one embodiment, the ratio of anti-foam to solvent ranges from 1:1 to 1:1000. In another embodiment, from 1:2 to 1:100. In a third embodiment, from 1:3 to 1:50. In one embodiment, the anti-foam agent is diluted in a sufficient amount of hydrocarbon solvent for it to have a viscosity of less than 1000 cSt, so it can be handled using standard equipment.

In one embodiment, the anti-foam is added directly to the heavy oil feedstock. In another embodiment, the mixture is injected into multiple points along an upflow reactor. In yet another embodiment, the anti-foam solvent mixture is injected to the top of the upflow reactor. In a fourth embodiment, the injection is into a region within the upper 30% of the reactor height. The injection of the anti-foam into the top of the reactor in one embodiment increases the liquid back mixing in the reactor.

Optional Additives—Inhibitors/Stabilizers/Sacrificial Materials: In one embodiment, in addition to or in place of the anti-foam agents, at least an additive selected from inhibitors, stabilizers, metal scavengers, metal contaminant removers, metal passivators, and sacrificial materials is added to the contacting zone in an amount ranging from 1 to 20,000 ppm of the heavy oil feed (collectively, "additive material"). In a second embodiment, the additive material is added in an amount of less than 10,000 ppm. In a third embodiment, the additive material ranges from 50 to 1000 ppm.

It should be noted that some additives may have multiple functions. In one embodiment, some metal scavengers may also function as metal contaminant removers and/or metal passivators under the appropriate conditions. In another embodiment, the sacrificial material used may function as a metal scavenger for adsorbing heavy metals in the heavy oil feed. Some other sacrificial materials, besides functioning as a metal scavenger for absorbing metals, also absorb or trap other materials including deposited coke.

In one embodiment, the additive material is added directly to the heavy oil feedstock. In another embodiment, the additive material is added to the slurry catalyst feed. In a third embodiment, the additive material is added to the contacting zone as a separate feed stream.

In one embodiment, the additive material can be added as is, or in a suitable diluent or carrier solvent. Exemplary carrier solvents include but are not limited to aromatic hydrocarbon solvents such as toluene, xylene, and crude oil derived aromatic distillates. Exemplary diluents include vacuum gas oil, diesel, decant oil, cycle oil, and or light gas oil. In some embodiments, the additive material may be dispersed in a small portion of the heavy oil feedstock.

In one embodiment, the additive material is injected into the top section of the reactor. In another embodiment, the additive material is injected into a plurality of feed ports along an upflow reactor.

In one embodiment, the additive material is selected to effect a good emulsification or dispersion of the asphaltenes in the heavy oil. In yet another embodiment, the additive is selected to increase storage stability and or improved pumpability of the heavy oil feedstock. In yet another embodiment, the additive is a stabilizer compound containing polar bonds such as acetone, diethyl ketone, and nitrobenze, added in an amount between 0.001 to 0.01 wt. % of the heavy oil feed.

In one embodiment, the additive material is an inhibitor additive, selected from the group of oil soluble polynuclear aromatic compounds, elastic modulus lowering agents, e.g., organic and inorganic acids and bases and metallo-porphyrins. In another embodiment, the additive is a selected alkoxylated fatty amine or fatty amine derivative and a special metal salt compound, e.g., a metal soap.

In one embodiment, the additive material is a "sacrificial material" (or "trapping material") which functions to trap, or for the deposit of, and/or immobilization of deposited coke and/or metals (Ni, V, Fe, Na) in the heavy oil feed, mitigating the detrimental effects on these materials on the catalyst and/or equipment. In another embodiment, the additive material functions to immobilize/adsorb the asphaltenes in the heavy oil feedstock, thus mitigating catalyst deactivation. In one embodiment, the sacrificial material has large pores, e.g, having a BET surface area of at least 1 $m^2/g$ in one embodiment, at least 10 $m^2/g$ in a second embodiment, and at least 25 $m^2/g$ in another embodiment. In yet another embodiment, the additive material is a sacrificial material having a pore volume of at least 0.005 $cm^3/g$. In a second embodiment, a pore volume of at least 0.05 $cm^3/g$. In a third embodiment, a total pore volume of at least 0.1 $cm^3/g$. In a fourth embodiment, a pore volume of at least 0.1 $cm^3/g$. In one embodiment, the sacrificial material has a pore volume of at least 0.5 $cm^3/g$. In another embodiment, at least 1 $cm^3/g$.

In one embodiment, the sacrificial material comprises a large pore inert material such microspheres of calcined kaolin clay. In another embodiment, the sacrificial material is characterized by having at least 20% of its pore volume constituted by pores of at least 100 Angstrom; and 150-600 Angstrom in a second embodiment.

Examples of additive materials for use in trapping deposits/metal scavenging include but are not limited to silicate compounds such as $Mg_2SiO_4$ and $Fe_2SiO_4$; inorganic oxides such as iron oxide compounds, e.g., $FeO.Fe_2O_3$, FeO, $Fe_3O_4$, $Fe_2O_3$, etc. Other examples of additive materials include silicate compounds such as fume silica, $Al_2O_3$, MgO, $MgAl_2O_4$, zeolites, microspheres of calcined kaolin clay, titania, active carbon, carbon black, and combinations thereof. Examples of metal passivators include but are not limited to alkaline earth metal compounds, antimony, and bismuth.

In one embodiment, the additive material is a commercially available metal scavenger from sources such as Degussa, Albermale, Phosphonics, and Polysciences. In one embodiment, the metal scavenger is a macroporous organo-function polysiloxane from Degussa under the tradename DELOXANE™.

In one embodiment, the scavenger/trapping/scavenger material originates from a slurry catalyst, specifically, a spent slurry catalyst in a dry powder form. In one embodiment, the spent slurry catalyst is from a heavy oil upgrade system having at least 75% of the heavy oil removed using means known in the art, e.g., deoiling via membrane filtration, solvent extraction, and the like. The spent slurry catalyst for use as a sacrificial material in one embodiment has a BET surface area of at least 1 $m^2/g$ for the trapping of coke/metals that would otherwise deposit along the reactor internals. In a second embodiment, the spent slurry catalyst has a BET surface area of at least 10 $m^2/g$. In a third embodiment, the BET surface area is greater than 100 $m^2/g$.

In one embodiment, the additive is a scavenger/trapping/scavenger material originated from a spent deoiled slurry catalyst, wherein some or most of the metals have been removed. In one embodiment, the additive is in the form of dried spent slurry catalyst having at least some or most of the metals such as nickel, molybdenum, cobalt, etc., removed from the spent catalyst. In one embodiment, the sacrificial material is in the form of solid residue comprising coke and some group VB metal complex, such as ammonium metavanadate, which residue is obtained after most of the metals such as molybdenum and nickel have been removed in a pressure leaching process. In yet another embodiment, the sacrificial material is in the form of solid residue comprising primarily coke, with very little vanadium left (in the form of ammonium metavanadate).

In another embodiment, the sacrificial material is carbon black which is selected due to its high surface area, various pore size structure, and easy recovery/separation from heavy metals by combustion. Furthermore, the carbon material is relatively soft, thus minimizing damage on let down valves and other plant materials. In one embodiment, the carbon material can be any generally commonly known and commercially available material. Examples include but are not limited to porous particulate carbon solid characterized by a size distribution ranging from 1 to 100 microns and a BET surface area ranging from 10 to over 2,000 $m^2/g$. In one embodiment, the carbon material has an average particle size ranging from 1 to 50 microns and a BET surface area from about 90 to about 1,500 $m^2/g$. In another embodiment, the carbon material has an average particle size ranging from 10 to 30 microns. Optionally, the catalyst material can be pretreated by one or more techniques as generally known in the art such calcination and/or impregnating first with the slurry catalyst prior to being fed into the upgrade system and/or mixed with the heavy oil feedstock.

In one embodiment, the additive material comprises activated carbon having large surface area, e.g., a pore area of at least 100 $m^2/g$, and a pore diameter range between 100 to 400 Angstrom. In one embodiment, the additive material is a commercially available powdered activated carbon from Norit as DARCO KB-G™ with a D-90 of 40 microns. In another embodiment, the commercially available carbon material is DARCO INSUL™ with a D-90 of 23 microns. In yet another embodiment, the additive material comprises carbon black obtained by the coking of spent slurry catalyst in heavy oil residual from a metal recovery process to recover/separate metals from a spent slurry catalyst.

In one embodiment, the additive material serves a plurality of function, e.g., deposit trapping/metal scavenging and anti-foaming, deposit trapping/metal scavenging and mesophases suppressing, etc., with the use of a surface treated sacrificial material. In one embodiment, the sacrificial material is surface treated (or coated) with at least an additive material such as an inhibitor and/or an anti-foam agent.

In one embodiment, the additive material is surface-modified carbon black. In one embodiment, the surface treated carbon black contains reactive function groups on the surface that provide the anti-foam properties, and with the requisite surface area and pore size structure to trap and/or immobilize deposited coke and/or metals (Ni, V, Fe, Na) in the heavy oil feed. In one embodiment, the additive is a surface-treated carbon black, with the carbon having been brought into contact with a heavy oil additive, e.g., a silicone compound such as dialkyl siloxane polymers, polydimethyl siloxane, polydiphenyl siloxane, polydiphenyl dimethyl siloxane, fluorinated siloxanes, and mixtures thereof.

In another embodiment, the multi-function additive is a sacrificial material surface treated with oil-soluble metal compounds such as carboxylic acids and salts of carboxylic acids, oil soluble polynuclear aromatic compounds, elastic modulus lowering agents, and other additive materials known in the art.

In yet another embodiment, anti-foam agents, e.g., silicone compounds, hydrocarbon-based anti-foam agents, are sprayed onto a carrier such as carbon black, titania, etc., one after another to generate a multi-function surface treated additive for use in the upgrade system.

Water Injection—Controlling Heavy Metal Deposit: The term "water" is used to indicate either water and/or steam. The term "water injection" is used interchangeably with "steam injection." In one embodiment, water is injected into the upgrade system at a rate of about[1] to 25 wt. % (relative to the heavy oil feedstock). In one embodiment, a sufficient amount of water is injected into at least one of the contacting zones for a water concentration in the system in the range of 2 to 15 wt. %. In a third embodiment, a sufficient amount is injected for a water concentration in the range of 4 to 10 wt. %.

The water can be added (injected) continually or intermittently as needed to control heavy metal deposit and/or improve the activity of the catalyst. The water can be added to the heavy oil feedstock before or after preheating. In one embodiment, a substantial amount of water is added to the heavy oil feedstock admixture that is to be preheated, and a substantial amount of water is added directly to the front end contacting zone(s). In another embodiment, water is added to the front-end contacting zone(s) via the heavy oil feedstock only. In yet another embodiment, at least 50% of the water is added to the heavy oil feedstock mixture to be heated, and the rest of the water is added directly to the front end contacting zone(s).

In one embodiment, water is introduced to the system as part of the slurry catalyst feed. In one embodiment, water is added to the slurry catalyst feed and pre-conditioned along with the slurry catalyst and hydrogen, prior to being fed to the system along with the heavy oil feed, or as a separate feed stream.

In one embodiment, the water introduced into the system at the preheating stage (prior to the preheating of the heavy oil feedstock), in an amount of about 1 to about 25 wt. % of the incoming heavy oil feedstock. In one embodiment, water is added to as part of the heavy oil feed to all of the contacting zones. In another embodiment, water is added to the heavy oil feed to the first contacting zone only. In yet another embodiment, water is added to the feed to the first two contacting zones only.

In one embodiment, water is added directly into the contacting zone at multiple points along the contacting zone, in ratio of 1 to 25 wt. % of the heavy oil feedstock. In yet another embodiment, water is added directly into the first few contacting zones in the process which are the most prone to deposits of heavy metals.

In one embodiment, some of the water is added to the process in the form of dilution steam. In one embodiment, at least 30% of the water added is in the form of steam. In the embodiments where water is added as dilution steam, the steam may be added at any point in the process. For example, it may be added to the heavy oil feedstock before or after preheating, to the catalyst/heavy oil mixture stream, and/or directly into the vapor phase of the contacting zones, or at multiple points along the first contacting zone. The dilution steam stream may comprise process steam or clean steam. The steam may be heated or superheated in a furnace prior to being fed into the upgrade process.

It is believed that the presence of the water in the process favorably alter the metallic compound sulfur molecular equilibrium, thus reducing the heavy metal deposit. The water/steam in the first contacting zone is expected to cut down on the heavy metal deposits onto the equipment. In one embodiment, the addition of water is also believed to help control/maintain a desired temperature profile in the contacting zones. In yet another embodiment, it is believed that the addition of water to the front end contacting zone(s) lowers the temperature of the reactor(s). The temperature of the first contacting zone can be kept at least 5-25 degrees (Fahrenheit) lower than the temperature of the next contacting zone in series.

As the reactor temperature is lowered, it is believed that the rate of reaction of the most reactive vanadium species slows down, allowing vanadium deposition onto the slurry catalyst to proceed in a more controlled manner and for the catalyst to carry the vanadium deposits out of the reactor thus limiting the solid deposit in the reactor equipment.

In one embodiment, the addition of water reduces the heavy metal deposits in the reactor equipment at least 25% compared to an operation without the addition of water, for a comparable period of time in operation, e.g., for at least 2 months. In another embodiment, the addition of water reduces heavy metal deposits at least 50% compared to an operation without the water addition. In a third embodiment, the addition of water reduces heavy metal deposits at least 75% compared to an operation without the water addition.

Optional Additional Hydrocarbon Feed: In one embodiment, additional hydrocarbon oil feed, e.g., VGO (vacuum gas oil), naphtha, MCO (medium cycle oil), light cycle oil (LCO), heavy cycle oil (HCO), solvent donor, or other aromatic solvents, etc., in an amount ranging from 2-40 wt. % of the heavy oil feed, can be optionally added as part of the feed to any of the contacting zones in the system.

In one embodiment, the additional hydrocarbon feed functions as a diluent to lower the viscosity of the heavy oil feed. In yet another embodiment, additional hydrocarbon feed is added as a way to control or stabilize the temperature in the upgrade system. The additional hydrocarbon feed can be added continuously or intermittently and/or varying amounts as needed to control the temperature in the system.

Controlling Heavy Metal Deposit with Reactor Temperature: In one embodiment, instead of and/or in addition to the addition of water to the front end contacting zone(s) in a sequential operation, the temperature of the front end contacting zone(s) most prone to heavy metal deposits is lowered.

In one embodiment, the temperature of the first reactor is set to be at least 10° F. (5.56° C.) lower than the next reactor in series. In a second embodiment, the first reactor temperature is set to be at least 15° F. (8.33° C.) than the next reactor in series. In a third embodiment, the temperature is set to be at least 20° F. (11.11° C.) lower. In a fourth embodiment, the temperature is set to be at least 25° F. (13.89° C.) lower than the next reactor in series.

Controlling Heavy Metal Deposit with Recycled Catalyst Stream: In one embodiment, at least a portion of the non-volatile stream from at least one of the separation zones, e.g., from an ISF or from the last separation zone, and/or an inter-stage deasphalting unit is recycled back to the front end contacting zone(s) to control the heavy metal deposits.

In one embodiment, this recycled stream ranges between 3 to 50 wt. % of total heavy oil feedstock to the process. In a second embodiment, the recycled stream is in an amount ranging from 5 to 35 wt. % of the total heavy oil feedstock to the system. In a fourth embodiment, the recycled stream is at least 10 wt. % of the total heavy oil feedstock to the system. In a fifth embodiment, the recycled stream is 15 to 35 wt. % of the total heavy oil feed. In a sixth embodiment, the recycled stream is at least 35 wt. %. In a seventh embodiment, the recycled stream ranges between 40 to 50 wt. % In an eight embodiment, the recycled stream ranges between 35 to 50 wt. %.

In one embodiment, the recycled stream comprises non-volatile materials from the last separation zone in the system, containing unconverted materials, heavier hydrocracked liquid products, slurry catalyst, small amounts of coke, asphaltenes, etc. In one embodiment, the recycled stream contains between 3 to 30 wt. % slurry catalyst. In another embodiment, the catalyst amount ranges from 5 to 20 wt. %. In yet another embodiment, the recycled stream contains 1 to 15 wt. % slurry catalyst.

In some embodiments, it is believed that with additional recycled catalyst provided by the recycled stream, more catalytic surface area (via the slurry catalyst in the recycled stream) is available to spread the heavy metal deposition, thus there is less trapping or deposition on the equipment. The additional catalyst surface areas provided by the recycled stream helps minimize overloading the catalyst surface with heavy metal deposit, leading to deposition on the process equipment (walls, internals, etc.).

System Performance: In one embodiment, at least 75 wt % of heavy oil feed is converted to lighter products in a high through-put one pass process (only one reactor is employed or multiple reactors are run in tandem/parallel). In another embodiment, a conversion rate of at least 80% is obtained with a slurry catalyst concentration in the range of 750-4000 wppm catalyst metal in a process with two reactors running in sequential mode. In a third embodiment, a conversion rate of at least 80% with a catalyst concentration in the range of 750-2500 wppm and a high heavy oil through-put of 0.15 LHSV. In a fourth embodiment, a concentration in the range of 1000-1500 wppm catalyst metal. As used herein, conversion rate refers to the conversion of heavy oil feedstock to less than 1000° F. (538° C.) boiling point materials.

In one embodiment, at least 85% of heavy oil feed is converted to lighter products with less than 5000 wppm catalyst metal in a process with three reactors in series, in either recycle mode or once-through mode. In another embodiment, the conversion rate is at least 98% with less than 2500 wppm catalyst metal. In yet another embodiment, the conversion rate is at least 85% with a slurry catalyst having a concentration of 1500-5000 wppm catalyst metal. In a fourth embodiment, the conversion rate is at least 90% with a slurry catalyst having a concentration of 1500-5000 wppm catalyst metal.

In one embodiment, the upgrade system provides a sulfur conversion rate of at least 60%, a nitrogen conversion of at least 20%, and MCR conversion of at least 50% for a slurry catalyst concentration in the range of 750-5000 wppm catalyst metal.

In one embodiment, the upgrade system produces a volume yield of at least 110% (compared to the heavy oil input) in upgraded products as added hydrogen expands the heavy oil total volume. The upgraded products, e.g., lower boiling hydrocarbons, in one embodiment include liquefied petroleum gas (LPG), gasoline, diesel, vacuum gas oil (VGO), and jet and fuel oils. In a second embodiment, the upgrade system provides a volume yield of at least 115% in the form of LPG, naphtha, jet & fuel oils, and VGO.

Depending on the conditions and location of the separation zone, in one embodiment, the amount of heavier hydrocracked products in the non-volatile fraction stream is less than 50 wt. % (of the total weight of the non-volatile stream). In a second embodiment, the amount of heavier hydrocracked products in the non-volatile stream from the separation zone is less than 25 wt. %. In a third embodiment, the amount of heavier hydrocracked products in the non-volatile stream from the separation zone is less than 15 wt. %. The amount of solids in the residue stream varies depending on the conversion level as well as optional additive materials employed, if any, e.g., sacrificial materials. In one embodiment, the solid level in the residue stream ranges from 1 to 10% solid in one embodiment, 2-5% solid in another embodiment, less than 30 wt. % solid in a third embodiment, and less than 40 wt. % solid in a fourth embodiment.

Figures Illustrating Embodiments: Reference will be made to the figures to further illustrate embodiments of the invention. In all embodiments, water and/or steam can be optionally introduced together with the feed and slurry catalyst in the same conduit, or as a separate feed stream to at least one of the contacting zones. Also in all embodiments, a recycle stream 152 containing at least a portion of the non-volatile stream from at least one of the ISFs or separating zones is optionally recycled back to at least one of the contacting zones.

FIG. 1 is a block diagram schematically illustrating a system 100 for upgrading heavy oil feedstock employing a slurry catalyst. First, a heavy oil feedstock 104 is introduced into the first contacting zone 120 in the system together with a slurry catalyst feed 110. The heavy oil feedstock 104 can be preheated in a heater prior to feeding into the contacting zone. Hydrogen 121 may be introduced together with the heavy oil/slurry catalyst feed in the same conduit 122 as shown, or optionally, as a separate feed stream. Water and/or steam can be optionally introduced together with the feed and slurry catalyst in the same conduit or a separate feed stream to the reactor. In one embodiment (not shown), the mixture of water, heavy oil feed, and slurry catalyst can be preheated in a heater prior to feeding into the contacting zone. Additional hydrocarbon oil feed 105, e.g., VGO, naphtha, etc., in an amount ranging from 2 to 30 wt. % of the heavy oil feed can be optionally added as part of the feed stream to any of the contacting zones in the system. In one embodiment, more than half of the heavy oil feed is converted in the first contacting zone and at least 25% of the hydrogen feed is consumed in the first contacting zone.

Effluent stream 123 comprising upgraded material, spent slurry catalyst, and unconverted heavy oil feed, hydrogen, etc., is withdrawn from the 1$^{st}$ contacting zone 120 and sent to ISF or separation zone 130. In one embodiment (shown in dotted lines), the effluent stream 123 is sent directly to the next contacting zone in series 140 without the need for the ISF 130. In yet another embodiment (as shown in dotted lines), a recycle stream 152 containing non-volatile stream from at least one of the ISFs or separating zones is recycled back to the front end contacting zone.

In the embodiment with the use of ISF 130, the ISF causes or allows the separation of gas and volatile liquids from the non-volatile fractions. In one embodiment, the gaseous and volatile liquid fractions 131 are withdrawn from the top of the separation zone 130 and taken for further processing in a lean contactor or a downstream process 160. The bottom stream 133 comprising slurry catalyst and entrained solids, coke, unconverted heavy oil feedstock, hydrocarbons newly generated in the hot separator, etc., is withdrawn and fed to the next contacting zone 140 in the series, resulting in additional reaction for more upgraded material.

In one embodiment, additional portions of the fresh catalyst feed 110 and heavy oil feedstock 104 are fed directly into the next contacting zone 140 in series as separate streams or a combined feed stream. In yet another embodiment, optional hydrocarbon oil feedstock 105 such as VGO is also fed into next contacting zone 140. In one embodiment, steam injection is also provided to the contacting zone 140 as a separate feed stream, or introduced together with the feed and slurry catalyst in the same conduit. In yet another embodiment, a recycled stream 152 containing a portion of the non-volatile stream from at least one of the ISFs or separating zones is also included as part to the feed to the contacting zone 140. Hydrogen 141 may be introduced together with the feed in the same conduit, or optionally, as a separate feed stream. In yet another embodiment (not shown), at least a portion or all of the hydrogen feed is mixed with the liquid stream 133 from the separation zone and fed into the reactor 140. The quench hydrogen in one embodiment supplies the reaction hydrogen as most of the hydrogen from the first contacting zone 120 left with the vapor stream 131. Steam injection is optional for contacting zone 140.

Effluent stream 142 comprising upgraded materials along with slurry catalyst, hydrogen gas, coke, unconverted heavy oil, etc., flows to the next separation zone 150 in series for separation of gas and volatile liquids 151 from the non-volatile fractions. The gaseous and volatile liquid fractions are withdrawn from the top of the separation zone, and combined with the gaseous and volatile liquid fractions from a preceding separation zone as stream 161 for further processing in hydrotreatment system 160 or a downstream product purification system. In one embodiment (not shown), stream 161 is quenched with a hydrocarbon stream such as LGO in a lean oil contactor.

The hydrotreater 160 in one embodiment employs conventional hydrotreating catalysts, is operated at a similarly high pressure (within 10 psig) as the rest of the upgrade system, and capable of removing sulfur, nitrogen and other impurities from the upgraded products with an HDN conversion level of >99.99%, lowering the sulfur level in fraction above 70° F. boiling point in stream 162 to less than 20 ppm in one embodiment, and less than 10 ppm in a second embodiment. In another embodiment, the in-line hydrotreater operates at a temperature within 10° F. of the temperature of the contacting zones.

The non-volatile (or less volatile) fraction stream is withdrawn and sent away as residue stream 152 for deoiling/metal recovery, or at least a portion is for recycling back to at least one of the contact zones as feed in one embodiment. In one embodiment of a recycled operation, a portion of the residue stream is removed as a bleed stream 171 from the system.

Figure 2:
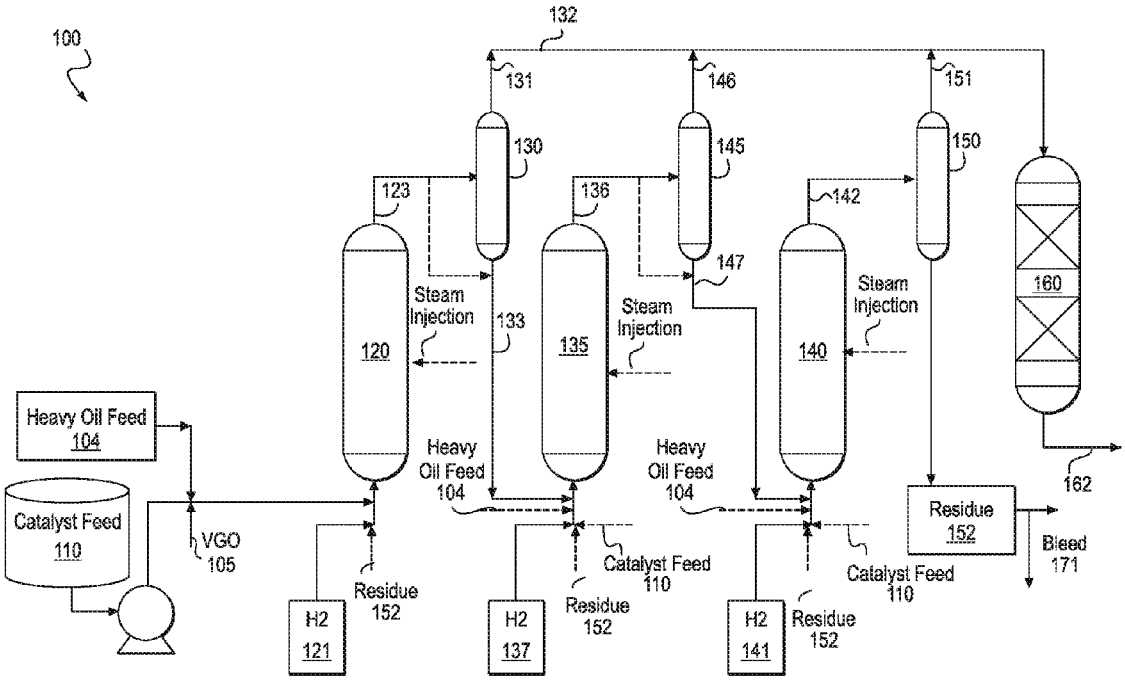
FIG. 2 is a flow diagram showing various embodiments of an upgrade process with three contacting zones running in sequential mode, including embodiments with each of the contacting zones having a separation zone in series and embodiments without ISFs and with optional recycle and/or water injection.

FIG. 2 is a flow diagram of another embodiment of an upgrade process 100 with the contacting zones running in sequential mode, e.g., reactors 120, 135, and 140. In one embodiment, the system operates with ISFs, e.g., each of the contacting zones having a separation zone in series. In another embodiment (as shown in dotted lines), the system operate with only one ISF (ISF 130 or ISF 145) in operation and with the effluents going directly from one contacting zone to the next, e.g., from reactor 120 to reactor 135 and by-passing ISF 130, or from reactor 135 directly to reactor 140 and by-passing ISF 145. In yet another embodiment, the system operates with only one separating zone, i.e., separator 150.

As shown, effluent stream 123 comprising upgraded material, spent slurry catalyst, and unconverted heavy oil feed, hydrogen, etc., withdrawn from the 1$^{st}$ contacting zone 120 is sent to separation zone 130, or directly to the second contacting zone 135 in series for further upgrading. Alternatively (shown as dotted line), the effluent streams 123 and/or 136 may by-pass the ISF 130 and/or ISF 145 and go directly into the next contacting zone (135 or 140) in series. Additional catalyst feed, heavy oil feedstock and other hydrocarbon feedstock such as VGO can also be fed to the next contacting zone in series along with additional hydrogen feed 137. Effluent stream 136 exits the contacting zone 135 and flows to separation zone 145, wherein gases (including hydrogen) and upgraded products in the form of volatile liquids are separated from the non-volatile liquid fraction 147 and removed overhead as stream 146. The non-volatile stream 147 is sent to the next contacting zone 140 in series for further upgrade.

Non-volatile stream 147 contains slurry catalyst in combination with unconverted oil, heavier hydrocracked liquid products, optional sacrificial material, and small amounts of coke and asphaltenes in some embodiments continues on to the next reactor 140 as shown. Additional feed stream(s) comprising hydrogen comprising gas, optional VGO feed, optional (additional) heavy oil feed, and optional catalyst feed can be combined with the non-volatile stream 147 for further upgrade reaction in the next reactor 140. Effluent stream 142 from the reactor comprising upgraded heavy oil feedstock flows to separation zone 150, wherein upgraded products are combined with hydrogen and removed as overhead stream 151. Bottom stream comprising non-volatile fractions, e.g., catalyst slurry, unconverted oil containing coke and asphaltenes, heavier hydrocracked liquid products, optional sacrificial material, etc., are removed as residue 152 for catalyst recovery/regeneration downstream. In one embodiment as show in dotted lines for a system in recycled mode, a portion of the residue 152 is sent to at least one of the contacting zones as recycled feed stream 152.

Figure 3:
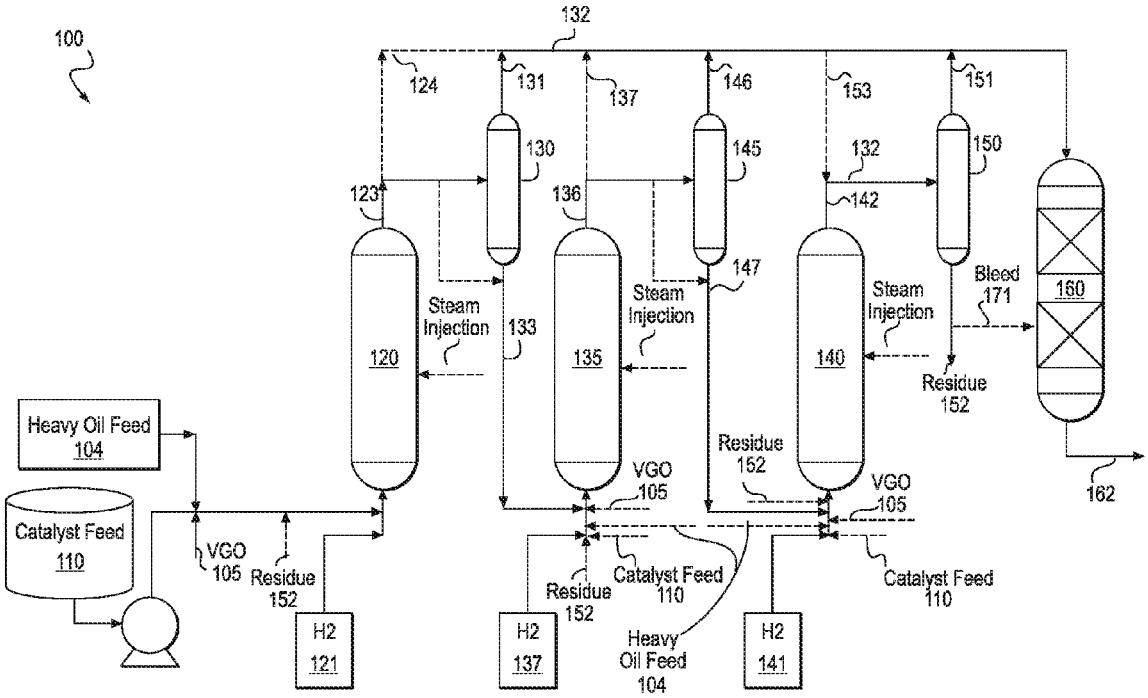
FIG. 3 is a flow diagram showing various embodiments of an upgrade process with three contacting zones running in tandem (parallel), with each of the contacting zones having a separation zone in series with optional by-pass allowing the system to operate with less ISFs, and embodiments with has optional recycle and/or water injection.

FIG. 3 is a flow diagram of another embodiment of an upgrade process as a parallel train with three contacting zones, e.g., reactors 120, 135, and 140. In one embodiment (shown in dotted line with optional by-pass), one separation zone can be used for all reactors in the system. In another embodiment, the system can be operated with one or two ISFs (shown in solid lines). In one embodiment, the system is operated at a high through put rate with all three reactors operating in parallel with each reactor having its own heavy oil feed, catalyst feed, optional VGO feed, etc., with the effluents going to one same separator 150 or individually to separate reactors, and the non-volatile fractions from the separators are collected for further processing as residue 152. In one embodiment (not shown, or indicated by dotted lines), the system operates at a slower rate with at least two of the reactors operating in series, with the non-volatile fraction from the separator being sent to the next reactor in series. In one embodiment, the effluent stream withdrawn from the reactor can be sent to the separator located in series after each reactor, e.g., streams 123 flowing to ISF 130, stream 136 to ISF 145, and stream 142 to separator 150, and the non-volatile streams from any of the separation zone can be removed/sent away to residue tank 152 for catalyst recovery/regeneration downstream.

In one embodiment (as shown as dotted lines) with all reactors sharing a separator, all the effluent streams are sent to separator 150, wherein the overhead stream is withdrawn as stream 151 and sent to a lean contactor or a downstream process 160. In one embodiment as show in dotted lines, a portion of the residue 152 is sent to at least one of the contacting zones as recycled feed stream 152.

In one embodiment, the upgrade process as illustrated in FIG. 3 with a plurality of contacting zones and separation zones is constructed in a permutable fashion so as to provide a flexible operation, accommodating different modes of operation. Although not shown in FIG. 3, appropriate equipment can be installed in the process to allow the upgrade system to switch from one operation mode to another, with one or more than one ISFs in operation, some reactors/ISFs on stand-by, varying the bleed rate, varying recycled rate, etc.

The different modes include but are not limited to the followings and combinations thereof: a) an operation with one reactor to two, or three (or more) reactors; b) an operation at low through-put rate but a high conversion rate with the plurality of reactors operating in a sequential fashion, i.e., operating in series, with the effluent from one reactor or the bottom liquid stream from a separator being sent to the next reactor in series for further conversion; c) an operation at a high through-put rate with at least some of the reactors running in tandem (parallel) and heavy oil feedstock to each of the reactors, and some of the reactor(s) being on stand-by or off-line mode; d) a mixed operation mode with one reactor running in tandem (parallel) with the other plurality of reactors running in series; e) an operation with the reactors running in tandem (parallel) with the effluent stream from each reactor being sent to a separator in series with the reactor(s); f) an operation with the reactors running in tandem (parallel), and with the effluent stream(s) from the reactors being combined and sent to one or two separators for separation and recovery of the upgraded products; g) an operation with all or some of the reactors in once-through mode; h) an operation with some or all of the reactors in recycle mode; and i) combinations of any of the above.

Although not described here, there can be other permutations of the above operating modes, such as a combined mode wherein the effluent from one reactor or the bottom liquid stream from a separator being split into multiple feed streams to two or more reactors in series. Additionally, as the system is set up as a flexible operation, any of the reactor can be operated as a primary or only reactor, a first reactor (or a second reactor, a third reactor, etc.) in a process running in a sequential fashion (or a mixed sequential/tandem model), and any of the separation zone can be operated as a primary or only separator, a first (second, or third, etc.) separation zone or the only separation zone in continuous process.

In one embodiment, the process allows a flexible operation with different types of heavy oil feeds, catalyst types, etc., with the reactors running in parallel with their own feed system. The flexibility of running in parallel and or series also allows one reactor to be shut down for clean up, removal of deposits, etc., while the remainder of the system operational. This means that the overall operation process efficiency is increased with minimum overall system downtime.

In one embodiment, the process allows a flexible conversion from one operating mode to another, without the need for unit shut-down and re-start. In one embodiment where only some of the contacting zones are kept in operation such as single reactor runs, the other reactor(s) are maintained in hot stand-by mode, i.e., at an elevated pressure and temperature as in the reactor(s) in operation. In one embodiment, pressure and temperature are maintained in the equipment on standby with hot hydrogen being circulated through the reactor or reactors not in operation and kept on stand-by.

In one embodiment, a sufficient amount of heated hydrogen containing gas feed is supplied to each of the stand-by reactors for the reactors to be at approximately the same temperature and pressure as the reactors in operation. As used herein, approximately the same (or similar to) temperature means that the temperature of the stand-by reactor is within 50° F. of the temperature of the reactors being in operation, and the pressure of the reactor on stand-by is within 100 psi of the pressure of the reactors in operation.

In one embodiment, the sufficient amount of hydrogen ranges from 10 to 100% of the hydrogen supplied to the reactor(s) in operation. In another embodiment, this sufficient amount of hydrogen ranges from 10 to 30%. In a fourth embodiment, the sufficient amount of hydrogen ranges from 15 to 25% of the total amount of hydrogen supplied to the reactors still in operation. The hot hydrogen stream exits the stand-by reactor or reactors and enters the separation zones, wherein it subsequently combines with the overhead stream and sent to a lean contactor or a downstream process for product purification.

Figure 4:
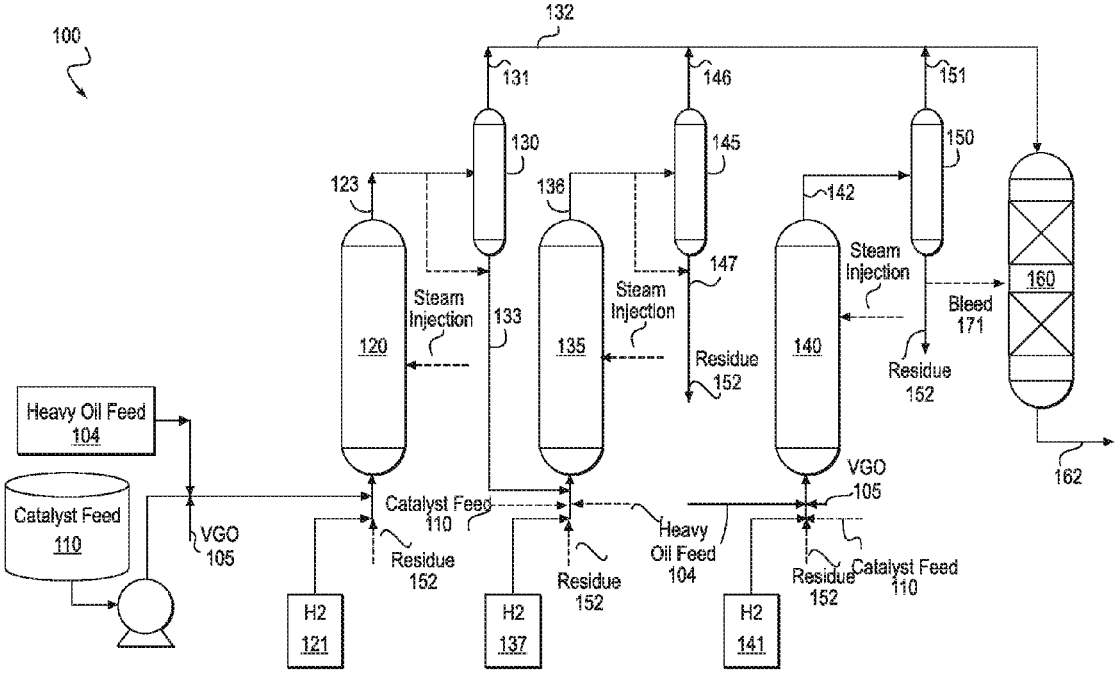
FIG. 4 is a flow diagram showing various embodiments of an upgrade process with a plurality of contacting zones and separation zones, with some of the contacting zones running in sequential mode, with the third reactor on stand-by, or running in tandem with separate feed streams, with optional recycle and/or water injection.

FIG. 4 illustrates one embodiment of a flexible upgrade process (a variation of FIG. 3), wherein only two of the reactors 120 and 135 in the system are engaged for heavy oil upgrade, and the third reactor system 140 is put on stand-by or back up mode with $H_2$ feed only, or it can be used for the upgrade of heavy oil as shown (employing a different catalyst and/or heavy oil feedstock). The third reactor 140 system can also be shut-down for maintenance while the other two are kept on-line.

As shown, reactors 120 and 135 are run in series, with the bottoms liquid stream 133 from the high pressure high temperature (HPHT) separator 130 is sent to reactor 135 for further upgrade. Volatile product streams from the overhead HPHT separators are combined with hot hydrogen 151 from the stand-by unit (or overhead stream with upgraded products if reactor 140 is in operation) and sent to a lean contactor or a downstream purification process. Bottoms stream comprising unconverted heavy oil, spent catalyst slurry, asphaltenes, etc. from the separator, e.g., 147 is collected as residue 152 and sent to a downstream process for deoiling and/or metal recovery in a metal recovery unit.

Also as indicated in the previous figures (shown in dotted line), the system can operate with one separation zone for all reactors in the system (i.e., without any ISF), with at least one ISF (shown in solid lines), or with a separator for each contacting zone. Additionally, in one embodiment with a recycled mode operation, a portion of the residue 152 can be sent to at least one of the contacting zones as recycled feed stream 152.

Figure 5:
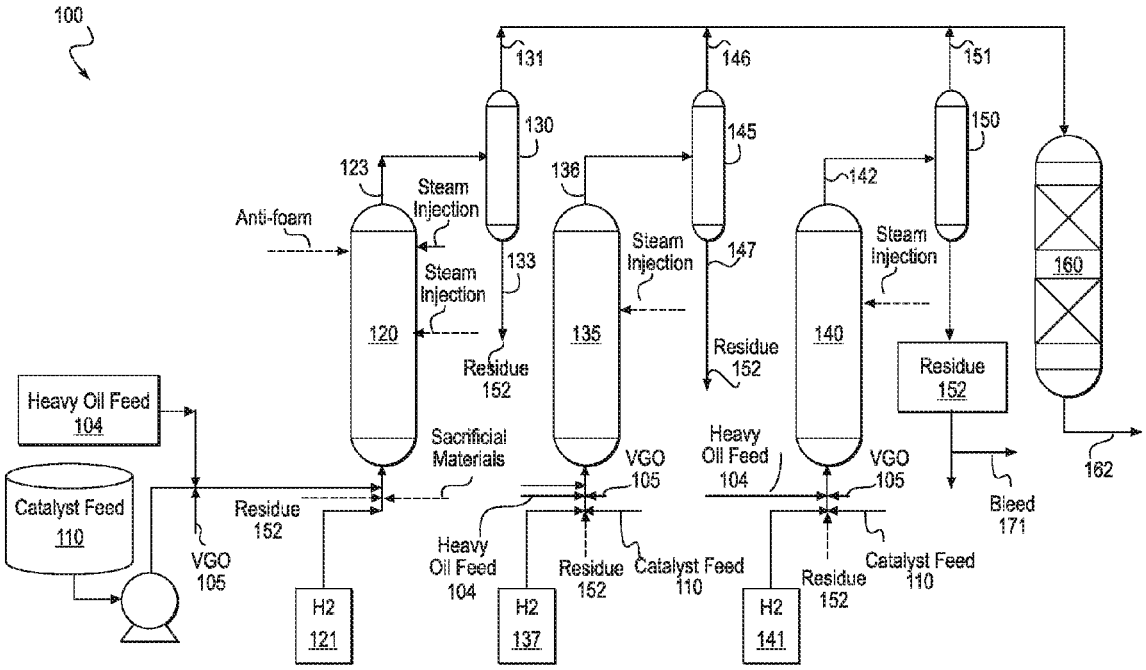
FIG. 5 is a flow diagram showing various embodiments of an upgrade process with the units running in tandem (parallel) with optional VGO, additive feeds, recycle and water injection to some of the contacting zones.

FIG. 5 illustrates another embodiment of the upgrade system (variation of FIG. 3), wherein all units are engaged for heavy-oil upgrade to maximize through-put, running in parallel with heavy oil feed 104, slurry catalyst feed 110, optional water injection to some of the reactors, optional additive materials such as anti-foam injection and/or sacrificial materials to some of the reactors, and optional VGO feed to some of the reactors running in tandem. Although not shown, it is noted that the effluents from any or all of the reactors can be directed to one single separator instead of running through a separator connected in series to the reactor (i.e., ISF), e.g., effluent streams 123 and 136 from reactors 120 and 140 respectively can be combined with the effluent stream 142 from the last reactor in the train, reactor 140, as feed separator 150. If the reactors are running as separate units with their own respective ISF, the bottom streams comprising unconverted heavy oil, spent catalyst, e.g., 133, 147, can be collected into one residue stream 152 and sent to a downstream process for deoiling and/or metal recovery in a metal recovery unit. The residue stream 152 contains small amounts of coke and asphaltenes, optional sacrificial material if any, and spent slurry catalyst in an amount of 5 to 30 wt. % in unconverted oil. Volatile product streams from the overhead HPHT separators are combined and sent to a lean contactor or a downstream product purification process.

In one embodiment with a recycled mode operation, a portion of the residue 152 can be sent to at least one of the contacting zones as recycled feed stream, with the bleed stream portion directly to downstream process for deoiling and/or metal recovery in a metal recovery unit, or a fractionator prior to de-oiling/metal recovery.

Figure 6:
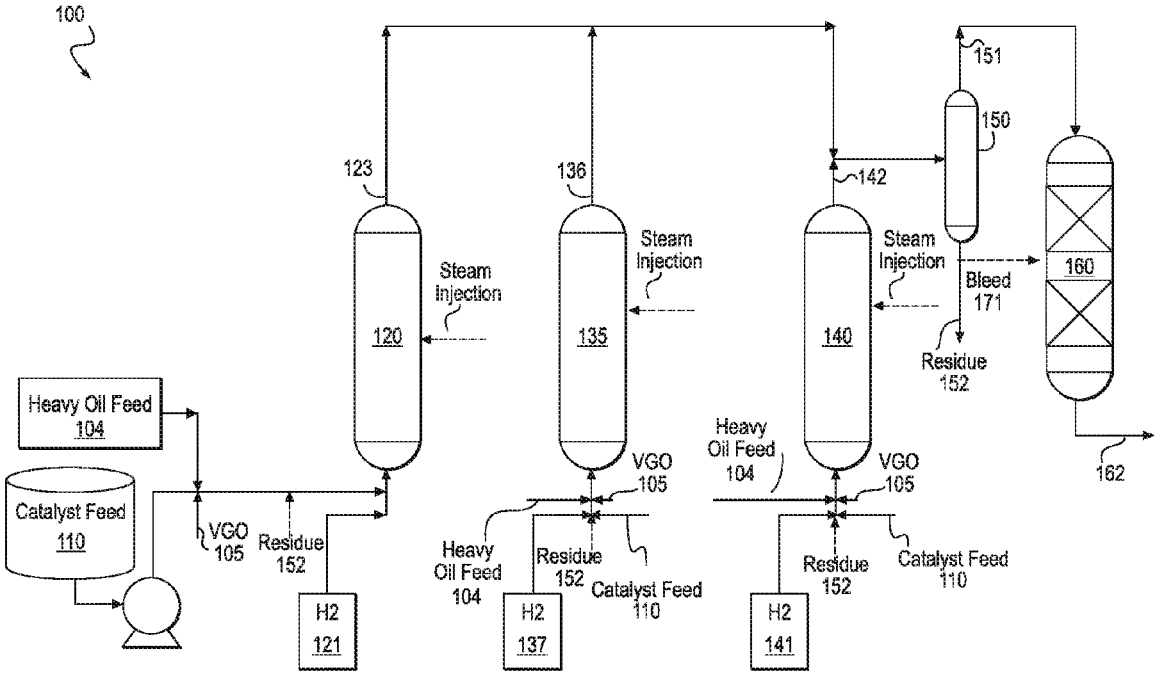
FIG. 6 is a flow diagram showing various embodiments of an upgrade process with three contacting zones running in tandem (parallel) and sharing one separation zone, with optional recycle and/or water injection.

FIG. 6 is a flow diagram of another embodiment of an upgrade process with three contacting zones running in tandem (parallel) and sharing one separation zone. As shown, each reactors 120, 135, and 140 run in tandem with their own separate heavy oil, catalyst, optional VGO, optional water injection (not shown), and optional additive feeds (not shown). The effluent streams 123, 136, and 142 from the reactors are combined and sent to one single separation zone 150 for the upgraded products to be separated from the residue stream comprising spent slurry catalyst, heavier hydrocarbons, and unconverted heavy oil feed. As the reactors operate in tandem as separate upgrade reactors, the heavy oil feedstock as well as the catalyst feed can be the same or different across the reactors. In one embodiment, at least a portion of the residue 152 can be sent to at least one of the contacting zones as recycled feed stream 152 with the rest removed as a bleed stream for further processing such as deoiling/metal recovery of spent catalyst.

Figure 7:
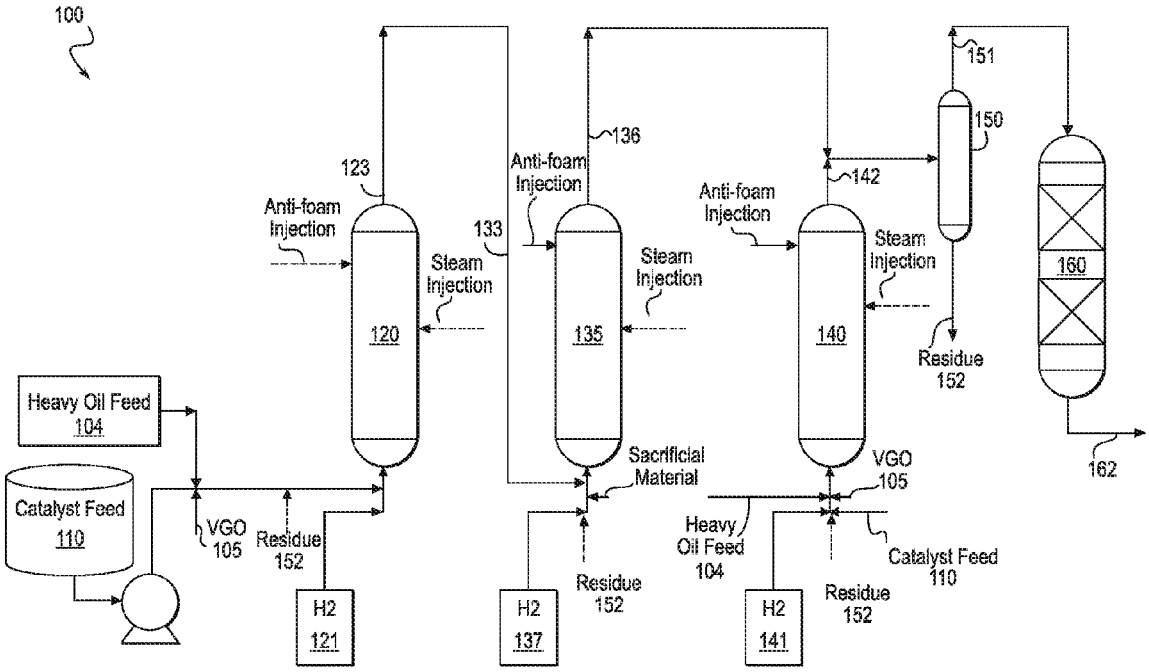
FIG. 7 is a flow diagram showing various embodiments of an upgrade process with two contacting zones running in sequential mode, which sequential run is in tandem with a single contacting zone in an upgrade operation with its own heavy oil feed, optional VGO feed, recycle, water injection, and catalyst feed.

FIG. 7 is another embodiment of an upgrade system, wherein the first two reactors 120 and 135 run in sequential mode. Although not shown, additional heavy oil feed as well as catalyst, optional additives, VGO feed, etc. can also be added to the second reactor 135 along with the effluent stream 123 from the first reactor. In one embodiment, at least a portion of the residue 152 can be sent to at least one of the contacting zones as recycled feed stream 152 with the rest removed as a bleed stream. The last reactor can be kept on stand-by mode with hot $H_2$ flowing through the reactor, or it can also be used for heavy oil upgrade as shown, with the last reactor 140 running in tandem with the sequential operation (reactors 120 and 135). The heavy oil feedstock, catalyst feed, and VGO feed to the last reactor 140 can be the same or different from the feeds to the sequential operation. In one embodiment as shown, effluent streams 136 and 142 from both operations are combined and sent to separation zone 150.

Although not shown in all of the Figures, the upgrade system may comprise recirculating/recycling channels and pumps (not shown) for promoting the dispersion of reactants, catalyst, and heavy oil feedstock in the contacting zones, particularly with a high recirculation flow rate to the first contacting zone to induce turbulent mixing in the reactor, thus reducing heavy metal deposits. In one embodiment, a recirculating pump circulates through the loop reactor, thus maintaining a temperature difference between the reactor feed point to the exit point ranging from 1 to 50° F., or between 2-25° F. In another embodiment, the recirculation is to limit the temperature difference across the contacting zone(s) due to exothermic reactions and ensure good contacting of the hydrogen and the reactants.

In the contacting zones under hydrocracking conditions, at least a portion of the heavy oil feedstock (higher boiling point hydrocarbons) is converted to lower boiling hydrocarbons, forming an upgraded product. It should be noted that at least a portion of the slurry catalyst remains with the upgraded feedstock as spent slurry catalyst, as the upgraded materials is withdrawn from the contacting zone and fed into the separation zone, and the spent slurry catalyst continues to be available in the separation zone and exits the separation zone with the non-volatile liquid fraction.

The following examples are given as non-limitative illustration of aspects of the present invention.

EXAMPLES

Heavy oil upgrade experiments were carried out in a system having three gas-liquid slurry phase reactors connected in series with two hot separators, each being connected in series with the $2^{nd}$ and $3^{rd}$ reactors respectively.

For all examples, a fresh slurry catalyst was prepared according to the teaching of US Patent No. 2006/0058174, e.g., a Mo compound was first mixed with aqueous ammonia forming an aqueous Mo compound mixture, sulfided with a sulfur-containing compound, promoted with a Ni compound, then transformed in a hydrocarbon oil, e.g., VGO, at a temperature of at least 350° F. and a pressure of at least 200 psig, forming an active slurry catalyst to send to the first reactor. The Mo concentration in VGO is 5% and the Ni/Mo ratio is 10% wt.

The heavy oil feedstock in the examples has properties as indicated in Table 1.

TABLE 1

| Feed Description | VR-1 | VR-H | VR-2 |
|---|---|---|---|
| Feed API | 2.5 | 1.35 | 2.70 |
| Feed Specific Gravity | 1.06 | 1.07 | 1.06 |
| Viscosity (100 C.), cst | 14548 | — | — |
| Viscosity (130 C.), cst | 1547 | 51847 | 8710 |
| Viscosity (150 C.), cst | NA | 5647 | 2102 |
| Feed Sulfur, wt % | 5.53 | 4.3675 | 5.12 |
| Feed Nitrogen, ppm | 5688 | 9907 | 7900 |
| Feed MCR, wt % | 25.4 | 27.9 | 29.9 |
| Feed Vanadium, ppm | 517.7 | 759.8 | 671.6 |
| Feed Nickel, ppm | 102.2 | 174.3 | 141.9 |
| Hot Heptane Asphaltenes, wt % | 16.3 | 19.2 | 25.7 |
| Feed VR (1000 F.+) Content, wt % | 86.4 | 95.5 | 95.7 |
| Feed HVGO (800 F.+) Content, wt % | 97.8 | 98.9 | 100 |
| Feed VGO (650 F.+) Content, wt % | 99.6 | 100 | 100 |
| Feed C, wt % | 83.71 | 84.30 | 83.24 |
| Feed H, wt % | 9.88 | 9.75 | 9.53 |
| H/C Ratio | 0.118 | 0.116 | 0.114 |

The upgrade system was operated under two modes: recycle and once-through. In the recycle mode, a portion of the non-volatile stream (STB or "stripper bottoms" product) from the last reactor was recycled back to the $1^{st}$ reactor and a portion is removed as a bleed stream. The STB stream amounts to about 30% of heavy oil feedstock to the system. The bleed stream amounts to about 15 wt. % of the heavy oil feedstock to the system. The STB stream contains about 10 to 15 wt. % slurry catalyst.

In all runs, effluent taken from the $1^{st}$ reactor was sent to the $2^{nd}$ reactor to continue with the upgrade reaction. Effluent streams from the $2^{nd}$ and $3^{rd}$ reactors were sent to the separators connected in series to the $2^{nd}$ and $3^{rd}$ reactor respectively, and separated into a hot vapor stream and a non-volatile stream. Vapor streams ("HPO" or high-pressure overhead streams) were removed from the top of the high pressure separators and collected for further analysis. The non-volatile stream comprising slurry catalyst and unconverted heavy oil feedstock from the $1^{st}$ separator was sent to the $3^{rd}$ reactor. The non-volatile stream comprising slurry catalyst and unconverted heavy oil feedstock from the $2^{nd}$ (last) separator is the STB stream, which was either recycled to the $1^{st}$ reactor (for "recycle" experiments) or sent away as a residue stream (for "once-through" experiments).

The hydroprocessing conditions were as follows: reactor temperature (in three reactors) in the range of 805-820° F., with the average reactor temperature as indicated in the Tables; a total pressure in the range of 2400 to 2600 psig; LHSV is as indicated in the table, ranging from 0.1 to 0.30 $h^{-1}$; and $H_2$ gas rate (SCF/bbl) of 7500 to 20000. For some of the runs, some of the reactors were taken off-line to increase the overall feed throughput (as indicated in the Tables with the number of reactors in operation).

As shown in Table 3 and at comparable LHSV, Example 8 in the once-through mode and at a low catalyst concentration (2500 ppm Mo/VR) gives a conversion rate that is comparable to the conversion rate obtained in Example Comp. 3, for an upgrade process operating in a recycle mode and a much higher catalyst concentration (4200 ppm). HVGO and VGO conversions were 93% and 78% respectively, along with high HDS, HDN, HD MCR and HDM conversions. The whole product API gravity gained nearly 31 degrees, similar to the recycle operation. The experiments indicated that the recycle stream could be removed without affecting the overall performance, and decreasing/increasing the catalyst level (2500-4200 ppm) did not significantly change the performance.

Attempts to run the upgrade system in a recycle mode and comparable (low) catalyst concentration of 2500 ppm Mo/VR were unsuccessful in Comparative Example 4, as the system never stabilized and with equipment issues due to the low conversion rate in the recycle mode (coke formation and solid depositions in the reactor).

Results from Example 1, Comparative Example 1 and Comparative Example 2 were evaluated to compare the conversion rate at different through put rates and a high catalyst rate (2.1% Mo). The vacuum resid (VR) conversion rate decreased as expected at higher through put rates, but was still with a conversion rate of >70% (71.74%). Additionally, more than 95% of the V and Ni in the feed were removed from the products and the whole product API gravity gained about 17 degrees compared to the VR feed.

Examples 2-7 were to evaluate the once-through upgrade system at various through put rates and low catalyst concentration (1500-2500 ppm). As shown in Example 2, >75% VR conversion was realized at 0.3 VR LHSV and 4200 ppm Mo. The HVGO and VGO conversion rates were 62% and 50% respectively, indicating that most of the VR have been converted to light hydrocarbon/oils. When the catalyst level was reduced to 2500 ppm (Example 3) or 1500 ppm (Example 4), VR conversion increased slightly due to the slight decrease in the overall LHSV. When the reactor temperature was increased from 818-819° F. to 825° F., the VR conversion rate increased to 79% with a low catalyst level of 2500 ppm Mo, which is a 40% reduction in catalyst usage compared to the usage in the recycle mode (Comparable Example 3). As shown in Examples 6-7, 92-94% VR conversion was obtained at 2500 ppm Mo with a whole product API gain of more than 26 degrees.

As noted, at a low catalyst to oil ratio (1500-4200 ppm) in once-through mode, at least 75% VR (1000° F.) conversion (75-79%) is obtained at a high VR throughput (0.3 LHSV) and at a high reactor temperature of 818-825° F. The VR conversion rate increased to 92-94% at 0.15 LHSV and at an almost full conversion rate of >98% at 0.1 LHSV and a high reactor temperature of 818-825° F. Also as noted, catalyst concentration in the reactors increased from one reactor to the next (in series), whether the upgrade system operated in either recycle mode or once-through mode.

Comparative Example 10

It is expected that running the upgrade system in the once-through mode with a very low catalyst concentration (250 ppm Mo/VR) would be unsuccessful, as the system would not stabilize with plugging problems, presumably with a low conversion rate due to the low catalyst concentration.

Example 13

In this example, a sacrificial material was employed to test the absorbance of asphaltenes and other deposits in the upgrade system. A material with a high capacity to selectively adsorb troublesome asphaltenes was employed. The material adsorbed asphaltenes thus preventing the asphaltenes from deactivating the catalyst, allowing the system to run with less catalyst while still maintaining a high conversion.

In Example 13 (see Table 4), two different sacrificial adsorbent materials were evaluated. C-2 is a commercial carbon black material from STREM Chemicals having an average size of 2-12 microns. C-1 is a carbon black obtained by the coking of spent slurry catalyst in heavy oil residual obtained from a previous upgrade run, having a D-90 of 10 microns (with particle size ranging from 2 to 12 microns), and BET surface area of 400 $m^2/g$. The carbonaceous material was charged at 3000 ppm Carbon/VR wt/wt in a batch reaction experiment with 112.5 g of a blend of heavy oil VR-1/cycle oil (3:2 ratio), and a catalyst level of 1.25% Mo to VR-1 heavy oil feed. The reaction was carried out at a pressure of 1600 psig hydrogen and with 2 or 5 hour soak at 825° F. The runs with the carbonaceous material were compared to batch reaction experiments without the sacrificial adsorbent. Table 4 summarizes the catalytic performance

TABLE 4

| Example 13 | Soak | % Conversion | | | | at. | dry |
|---|---|---|---|---|---|---|---|
| Run type | (hr) | HDN | HDS | HDMCR | VR | H/C | solids |
| Comparable - no C mat. | 2 | 33.9 | 78.1 | 64.7 | 88.0 | 1.33 | 2.70 |
| C-2 material | 2 | 38.4 | 77.6 | 63.8 | 83.6 | 1.33 | 2.60 |
| C-1 material | 2 | 38.8 | 77.2 | 64.3 | 74.6 | 1.32 | 2.50 |
| Comparable - no C mat. | 5 | 45.8 | 85.7 | 77.7 | 96.1 | 1.29 | 2.10 |
| C-2 material | 5 | 52.9 | 86.3 | 75.7 | 94.6 | 1.35 | 2.60 |
| C-1 material | 5 | 50.0 | 85.4 | 76.7 | 94.3 | 1.30 | 2.30 |

Comparative Example 14

Heavy oil upgrade experiments were carried out in a system having three gas-liquid slurry phase reactors connected in series with three hot separators, each being connected in series with the reactors. The upgrade system was run continuously for about 50 days.

A fresh slurry catalyst used was prepared according to the teaching of US Patent No. 2006/0058174, i.e., a Mo compound was first mixed with aqueous ammonia forming an aqueous Mo compound mixture, sulfided with hydrogen compound, promoted with a Ni compound, then transformed in a hydrocarbon oil (other than heavy oil feedstock) at a temperature of at least 350° F. and a pressure of at least 200 psig, forming an active slurry catalyst to send to the first reactor.

The hydroprocessing conditions were as follows: a reactor temperature (in three reactors) of about 825° F.; a total pressure in the range of 2400 to 2600 psig; a fresh Mo/fresh heavy oil feed ratio (wt. %) 0.20-0.40; fresh Mo catalyst/total Mo catalyst ratio 0.125-0.250; total feed LHSV about 0.070 to 0.15; and $H_2$ gas rate (SCF/bbl) of 7500 to 20000.

Effluent taken from each reactor was sent to the separator (connected in series), and separated into a hot vapor stream and a non-volatile stream. Vapor streams were removed from the top of the high pressure separators and collected for further analysis ("HPO" or high-pressure overhead streams). The non-volatile stream containing slurry catalyst and unconverted heavy oil feedstock was removed from the separator and sent to the next reactor in series.

A portion of the non-volatile stream from the last separator in an amount of 30 wt. % of heavy oil feedstock was recycled (STB), and the rest was removed as a bleed stream (in an amount of about 15 wt. % of the heavy oil feedstock). The STB stream contains about 10 to 15 wt. % slurry catalyst.

The feed blend to the system was high metals heavy crude with the properties specified in Table 5.

TABLE 5

| | VR feed |
|---|---|
| API gravity at 60/60 | — |
| Specific gravity | 1.0760 |
| Sulfur (wt %) | 5.27015 |
| Nitrogen (ppm) | 7750 |
| Nickel (ppm) | 135.25 |
| Vanadium (ppm) | 682.15 |
| Carbon (wt %) | 83.69 |
| Hydrogen (wt %) | 9.12 |
| H/C Ratio | 0.109 |

After 50 days of operation, the operation was shut down. The reactor, distributor and internal thermowell were visually inspected. All three pieces show significant built-up of deposit, with approximately 28.5% of the volume of the front-end ($1^{st}$) reactor being lost due to deposits of heavy metals. Analysis of the used slurry catalyst in the bleed stream over the 50 day period showed an increasing deficit in vanadium, suggesting that the deposit build up inside the front end reactor was not only happening but actually worsening over the course of the run. The performance of the process also suffered, due to the loss in the reaction volume.

Example 15

Example 14 was repeated, except that the temperature of the $1^{st}$ reactor was decreased 20° F. (from about 825° F. to about 805° F.), the recycled catalyst rate was increased from 30 wt. % (in Example 1) to about 40 wt. % of the heavy oil feed rate, and water was added to the front end reactor at a rate equivalent to 5 wt. % of the heavy oil feed rate. The system ran for 54 days before shutdown.

Water injection was carried out by adding water to the fresh catalyst, then the water catalyst mixture was added to an autoclave along with the heavy oil feed and hydrogen, with the mixture being pre-heated to a temperature of about 350° F.

Analysis of the used slurry catalyst in the bleed stream over the 54 day period showed a fairly close agreement between the amount of vanadium expected to exit the process and the amount of vanadium in the catalyst in the bleed stream, suggesting that vanadium trapping has significantly reduced, thus heavy metal deposit in the equipment.

The analytical results were further confirmed by visual inspections of the reactor internals, distributor, and internal thermowell. The equipment was significantly cleaner in Example 15, with only 6.6% of the front end reactor volume being lost due to heavy metal deposits.

HDN means hydrodenitrogenation; HDS means hydrodesulfurization; HDMCR means hydrodemicrocarbon residue; VR means vacuum residue; at. H/C means atomic hydrogen to carbon ratio; and dry solids values were measured according to methods known in the art. HDN is a common measure for hydrogenation activity of a catalyst. As shown, runs employing carbonaceous sacrificial material showed a consistent increase in HDN activity at both 2 and 5 hour soak times compared to the control without the carbon.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

TABLE 2

| | Ex. 1 | Comp. 1 | Comp. 2 | Ex. 2 | Ex. 3 | Ex. 4 | Ex. 5 | Ex. 6 | Ex. 7 | Ex. 11 | Ex. 12 |
|---|---|---|---|---|---|---|---|---|---|---|---|
| Feed ID | VR-1 | VR-1 | VR-1 | VR-H | VR-H | VR-H | VR-H | VR-H | VR-H | VR-2 | VR-2 |
| Operation mode | Once-Thru | Once-Thru | Once-Thru | Once-thru | Once-thru | Once-thru | Once-thru | Once-thru | Once-thru | Once-thru | Once-thru |
| # of reactors | 1 | 2 | 3 | 1 | 1 | 1 | 1 | 2 | 2 | 3 | 3 |
| VR LHSV, $h^{-1}$ | 0.201 | 0.101 | 0.065 | 0.30 | 0.30 | 0.30 | 0.30 | 0.15 | 0.15 | 0.09 | 0.09 |
| Overall (VR + VGO in catalyst) LHSV, $h^{-1}$ | 0.294 | 0.148 | 0.096 | 0.329 | 0.317 | 0.312 | 0.317 | 0.158 | 0.157 | 0.096 | 0.106 |
| Total $H_2$ rate to reactors in service, scf/bbl-VR | 10782 | 10503 | 10914 | 2506 | 2512 | 2510 | 2502 | 2510 | 2508 | 2506 | 2506 |
| Unit pressure (psig) | 2482 | 2488 | 2480 | 4500 | 4500 | 4500 | 4500 | 9000 | 6000 | 13500 | 13500 |

TABLE 2-continued

| | Ex. 1 | Comp. 1 | Comp. 2 | Ex. 2 | Ex. 3 | Ex. 4 | Ex. 5 | Ex. 6 | Ex. 7 | Ex. 11 | Ex. 12 |
|---|---|---|---|---|---|---|---|---|---|---|---|
| Average temperature of reactors in service, F. | 805 | 807 | 810 | 819 | 818 | 819 | 825 | 819 | 819 | 816.3 | 817.3 |
| Actual Cat (Mo) to Oil (VR) Ratio (ppm) | 21192 | 21087 | 21782 | 4200 | 2500 | 1500 | 2500 | 2500 | 2500 | 3000 | 3000 |
| VR feed API | 2.5 | 2.5 | 2.5 | 1.35 | 1.35 | 1.35 | 1.35 | 1.35 | 1.35 | 2.70 | 2.70 |
| HPO API | 41.8 | 43.8 | 44.3 | 7.6 | 6.4 | 5.5 | 7.0 | 4.6 | 5.3 | 2.2 | 1.7 |
| STB API | 15.8 | 21.1 | 26.9 | 43.2 | 42.0 | 42.9 | 44.3 | 37.4 | 40.1 | 36.1 | 35.9 |
| Whole product API | 19.5 | 26.1 | 34.1 | 19.5 | 18.5 | 18.7 | 20.4 | 27.7 | 27.7 | 32.1 | 31.4 |
| Sulfur conversion, % | 72.88 | 91.59 | 99.28 | 65.99 | 64.97 | 63.48 | 67.52 | 85.89 | 84.31 | 91.42 | 90.12 |
| Nitrogen conversion, % | 26.08 | 56.33 | 91.43 | 21.90 | 21.02 | 20.84 | 25.56 | 42.59 | 41.66 | 59.77 | 60.01 |
| MCR conversion, % | 62.17 | 85.10 | 98.87 | 56.53 | 56.41 | 55.34 | 58.16 | 82.46 | 78.55 | 94.54 | 93.11 |
| 1000 F.+ conversion, % | 71.74 | 89.39 | 99.00 | 75.51 | 76.17 | 77.61 | 78.58 | 93.57 | 91.87 | 98.01 | 97.50 |
| 800 F.+ conversion, % | 48.97 | 72.03 | 89.13 | 62.16 | 63.42 | 64.49 | 66.47 | 84.34 | 82.38 | 90.94 | 90.41 |
| 650 F.+ conversion, % | 31.94 | 52.54 | 74.42 | 49.51 | 51.30 | 51.99 | 53.90 | 69.38 | 68.83 | 75.14 | 74.34 |
| HD-vanadium, % | 95.48 | 99.84 | 100.00 | 86.40 | 85.18 | 83.66 | 87.31 | 98.49 | 97.69 | — | — |
| HD-nickel, % | 98.50 | 99.89 | 100.00 | 75.28 | 71.93 | 68.82 | 74.15 | 92.13 | 89.81 | — | — |

TABLE 3

| | Ex. 8 | Ex 9 | Ex 10 | Comp. 10 | Comp. 3 | Comp. 4 |
|---|---|---|---|---|---|---|
| Feed Type | VR-H | VR-H | VR-H | VR-H | VR-H | VR-H |
| Operation mode | Once-thru | Once-thru | Once-thru | Once-thru | Recycle | Recycle |
| Number of reactors in service | 3 | 3 | 3 | 3 | 3 | 3 |
| VR LHSV, $h^{-1}$ | 0.10 | 0.10 | 0.10 | 0.10 | 0.10 | 0.10 |
| Overall (VR + VGO in catalyst) LHSV, $h^{-1}$ | 0.105 | 0.107 | 0.109 | 0.109 | 0.109 | 0.109 |
| Unit Pressure, psig | 2502 | 2505 | 2497 | 2497 | 2505 | 2505 |
| Total $H_2$ Rate - scf/bbl-VR | 13500 | 13500 | 13500 | 13500 | 13500 | 13500 |
| Average temperature of the reactors in service, F. | 818.7 | 818.7 | 819.3 | 819.3 | 819 | 819 |
| Mo/VR ratio, ppm | 2500 | 3000 | 4200 | 250 | 4200 | 2500 |
| VR Feed API | 1.35 | 1.35 | 1.35 | 1.35 | 1.35 | 1.35 |
| STB API | 0.8 | 2.3 | 3.3 | — | 3.9 | — |
| HPO API | 36.2 | 36.3 | 36.1 | — | 35.9 | — |
| Whole product API | 32.2 | 32.2 | 32.2 | — | 32.3 | — |
| Sulfur Conversion, % | 91.71 | 91.12 | 92.83 | — | 92.81 | — |
| Nitrogen Conversion, % | 55.96 | 59.94 | 61.11 | — | 58.90 | — |
| MCR Conversion, % | 94.18 | 94.47 | 94.77 | — | 94.36 | — |
| VR (1000 F.+) Conversion, % | 98.34 | 98.37 | 98.37 | — | 98.18 | — |
| HVGO (800 F.+) Conversion, % | 92.85 | 92.54 | 92.74 | — | 92.11 | — |
| VGO (650 F.+) Conversion, % | 78.28 | 78.07 | 78.15 | — | 77.61 | — |
| HD-vanadium, % | 99.79 | 99.83 | 99.86 | — | 99.83 | — |
| HD-Nickel, % | 97.54 | 97.55 | 97.66 | — | 97.88 | — |
| Mo concentration in 1st reactor, ppm[a] | 4050 | na | na | — | 16500 | — |
| Mo concentration in 2nd reactor, ppm[a] | 11500 | na | na | — | 26600 | — |
| Mo concentration in 3rd reactor, ppm[a] | 51900 | 66900 | 93500 | — | 44500 | — |
| Mo concentration in STB product (OUT), ppm | 17700 | 21700 | 30900 | — | 32500 | — |

The invention claimed is:

1. A process for hydroprocessing a heavy oil feedstock, the process employing at least three contacting zones and at least two separation zones, wherein at least one separation zone comprises an interstage flash separator (ISF) interposed between two contacting zones, the process comprising:

combining the heavy oil feedstock, a hydrogen containing gas, and a slurry catalyst in a first contacting zone under hydrocracking conditions to convert at least a portion of the heavy oil feedstock to upgraded products comprising lower boiling hydrocarbons, and form a mixture comprising the upgraded products comprising lower boiling products, the slurry catalyst, the hydrogen containing gas, and an unconverted portion of the heavy oil feedstock;

sending the mixture comprising the upgraded products comprising lower boiling products, the slurry catalyst, the hydrogen containing gas, and the unconverted portion of the heavy oil feedstock to the ISF to separate, as an overhead stream, the upgraded products comprising lower boiling products and the hydrogen containing gas and, as a first non-volatile stream, the slurry catalyst and the unconverted portion of the heavy oil feedstock;

wherein the first non-volatile stream is sent to a subsequent contacting zone other than the first contacting zone, which subsequent contacting zone is maintained under hydrocracking conditions with an additional hydrogen containing gas feed, to convert at least a portion of the unconverted portion of the heavy oil feedstock to lower boiling hydrocarbons and form additional upgraded products comprising lower boiling hydrocarbons;

sending a mixture comprising the additional upgraded products, the slurry catalyst, the hydrogen containing gas, the additional hydrogen containing gas, and unconverted heavy oil feedstock from the subsequent contacting zone to at least a separation zone, whereby the additional upgraded products are removed with the additional hydrogen containing gas as an overhead stream, and the slurry catalyst and the unconverted heavy oil feedstock are removed as an additional non-volatile stream;

recycling at least a portion of the additional non-volatile stream in an amount between 2 to 50 wt. % of the heavy oil feedstock to at least one of the contacting zones as a recycled catalyst stream, wherein the slurry catalyst comprises a recycled slurry catalyst and a fresh slurry catalyst, wherein at least a portion of the fresh slurry catalyst is fed into a contacting zone other than the first contacting zone, and wherein the number of contacting zones in operation is equal or greater than the number of separation zone(s) in operation.

2. The process of claim 1, wherein water is added to at least one of the contacting zones in an amount of 1 to 25 weight % on the weight of the heavy oil feedstock.

3. The process of claim 2, wherein water is added to the first contacting zone.

4. The process of claim 3, wherein the water is added directly to the heavy oil feedstock forming a mixture prior to feeding the mixture to the first contacting zone.

5. The process of claim 4, wherein the mixture of water and heavy oil feedstock is preheated at a temperature of at least 50° C. below the hydrocracking temperature.

6. The process of claim 2, wherein at least a portion of the water is added as steam injection.

7. The process of claim 6, wherein the steam is injected into a plurality of feed points in the at least one of the contacting zones.

8. The process of claim 2, wherein water is added directly into at least a contacting zone at multiple points along the contacting zone, in an amount ranging from 1 to 20 wt. % of the heavy oil feedstock.

9. The process of claim 1, wherein at least a portion of the non-volatile stream from the at least a separation zone is recycled to at least one of the contacting zones for use as a recycled slurry catalyst, and remainder of the non-volatile stream is removed from the process as a bleed-off stream in an amount sufficient for the process to have a conversion rate of at least 85%.

10. The process of claim 1, wherein at least a portion of the non-volatile stream from the at least a separation zone is recycled to at least one of the contacting zones for use as a recycled slurry catalyst, and remainder of the non-volatile stream is removed from the process as a bleed-off stream in an amount sufficient for the process to have a conversion rate of at least 90%.

11. The process of claim 10, wherein remainder of the non-volatile stream is removed from the process as a bleed-off stream in an amount sufficient for the process to have a conversion rate of at least 95%.

12. The process of claim 11, wherein the recycled stream is sent to the first contacting zone.

13. The process of claim 11, wherein the at least a portion of the non-volatile stream for recycling to at least one of the contacting zones ranges between 3 to 25 wt, % of the heavy oil feedstock to the process.

14. The process of claim 11, wherein the bleed-off stream contains between 3 to 20 wt. % solid as slurry catalyst.

15. The process of claim 11, wherein the bleed-off stream contains between 3 to 10 vol. % solid as slurry catalyst.

16. The process of claim 1, wherein the at least a separation zone is maintained at a temperature within 90° F. of the temperature of the contacting zones, and a pressure within 10 psi of the pressure in the contacting zones.

17. The process of claim 1, wherein additional hydrocarbon oil feed other than heavy oil feedstock, in an amount ranging from 2 to 30 volume % of the heavy oil feedstock, is added to any of the contacting zones.

18. The process of claim 17, wherein the additional hydrocarbon oil feed is selected from vacuum gas oil, naphtha, medium cycle oil, solvent donor, and aromatic solvents.

19. The process of claim 1, wherein the recycled slurry catalyst is from the non-volatile stream from the at least a separation zone.

20. The process of claim 19, wherein all of the fresh slurry catalyst is for feeding a contacting zone other than the first contacting zone.

21. The process of claim 1, further comprising providing at least an additive material selected from inhibitor additives, anti-foam agents, stabilizers, metal scavengers, metal contaminant removers, metal passivators, and sacrificial materials, in an amount ranging from 1 to 20,000 ppm of the heavy oil feedstock to the first contacting zone.

22. The process of claim 21, wherein the additive material comprises a spent slurry catalyst sacrificial material with a BET surface area of at least 1 $m^2/g$.

23. The process of claim 1, wherein the first contacting zone operates at an exit pressure X, and X is at most 100 psi higher than an entry pressure Y of a contacting zone or a separating zone in series with the first contacting zone.

24. The process of claim 1, wherein the plurality of contacting zones are configured in a permutable fashion for the plurality of contacting zones to operate in: a sequential mode; a parallel mode; a combination of parallel and sequential mode; all online; some online and some on stand-by; some online and some off-line; a parallel mode with the effluent stream from the contacting zone being sent to at least a separation zone in series with the contacting zone; a parallel mode with the effluent stream from the contacting zone being combined with an effluent stream from at least another contacting zone and sent to the separation zone; and combinations thereof.

25. The process of claim 1, wherein the ISF operates in full ISF mode.

26. The process of claim 25, wherein the ISF operates in partial ISF mode.

27. The process of claim 1, further comprising feeding additional slurry catalyst to the contacting zone other than the first contacting zone.

28. The process of claim 27, wherein the additional slurry catalyst feed to the contacting zone other than the first contacting zone is a different from the shiny catalyst feed to the first contacting zone.

29. The process of claim 1, wherein the process further employs at least an additional separation zone for treating the non-volatile stream from the at least a separation zone, wherein the additional separation zone operates at a lower pressure than the at least a separation zone for removing lighter products from the non-volatile stream prior to further treatment for de-oiling or metal recovery.

30. A process for hydroprocessing a heavy oil feedstock, the process employing at least three contacting zones and at least two separation zones, including a first contacting zone and a contacting zone other than the first contacting zone, wherein one of the separation zones is an ISF interposed between the first contacting zone and the contacting zone other than the first contacting zone, the process comprising:

combining the heavy oil feedstock, a hydrogen containing gas, and a slurry catalyst in the first contacting zone under hydrocracking conditions to convert at least a portion of the heavy oil feedstock to lower boiling hydrocarbons and form upgraded products;

sending a mixture comprising the upgraded products, the slurry catalyst, the hydrogen containing gas, and an unconverted portion of the heavy oil feedstock to the ISF, whereby the upgraded products are separated with the hydrogen containing gas as an overhead stream, and the slurry catalyst and the unconverted portion of the heavy oil feedstock are separated as a first non-volatile stream; and combining the first non-volatile stream with an additional hydrogen containing gas to form a combined stream and sending the combined stream to the contacting zone other than the first contacting zone, which other contacting zone is maintained under hydrocracking conditions to convert at least an additional portion of the unconverted heavy oil feedstock to lower boiling hydrocarbons and form additional upgraded products and a remaining amount of unconverted heavy oil feedstock;

sending a mixture comprising the additional upgraded products, the slurry catalyst, the additional hydrogen containing gas, and the remaining amount of unconverted heavy oil feedstock from the contacting zone other than the first contacting zone to at least a separation zone, whereby the additional upgraded products are removed with the additional hydrogen containing gas as an additional overhead stream, and the slurry catalyst and the remaining amount of unconverted heavy oil feedstock are removed as an additional non-volatile fraction;

collecting the additional overhead stream for further processing; and collecting the additional non-volatile fraction for further processing;

wherein the number of contacting zones in operation is equal or greater than the number of separation zone(s) in operation and wherein all of the additional non-volatile fraction is collected for further processing in a fractionator or a de-oiling unit and, wherein the additional non-volatile fraction is further processed in a fractionator, wherein the fractionator operates at a lower pressure than the at least a separation zone for removing lighter products from the additional non-volatile stream prior to further treatment for de-oiling or metal recovery.

31. The process of claim 30, wherein the ISF operates in full ISF mode.

32. The process of claim 31, wherein the ISF operates in partial ISF mode.

* * * * *